US010712112B2

(12) United States Patent
Maeda

(10) Patent No.: US 10,712,112 B2
(45) Date of Patent: Jul. 14, 2020

(54) TOY GUN

(71) Applicant: MARUZEN COMPANY LIMITED, Tokyo (JP)

(72) Inventor: Tetsuo Maeda, Tokyo (JP)

(73) Assignee: MARUZEN COMPANY LIMITED, Tokyo (JP)

( * ) Notice: Subject to any disclaimer, the term of this patent is extended or adjusted under 35 U.S.C. 154(b) by 0 days.

(21) Appl. No.: 16/373,368

(22) Filed: Apr. 2, 2019

(65) Prior Publication Data

US 2019/0301824 A1 Oct. 3, 2019

(30) Foreign Application Priority Data

Apr. 2, 2018 (JP) ..... 2018-071047

(51) Int. Cl.

| | |
|---|---|
| ***F41A 17/56*** | (2006.01) |
| ***F41A 35/06*** | (2006.01) |
| ***F41B 11/89*** | (2013.01) |
| *F41A 17/74* | (2006.01) |
| *F41A 17/46* | (2006.01) |

(52) U.S. Cl.

CPC ..... *F41A 17/56* (2013.01); *F41B 11/89* (2013.01); *F41A 17/46* (2013.01); *F41A 17/74* (2013.01); *F41A 35/06* (2013.01)

(58) Field of Classification Search

CPC ..... F41A 17/00; F41A 17/56; F41A 35/06; F41B 11/89

USPC ..... 124/73; 42/70.01, 70.04, 70.05

See application file for complete search history.

(56) References Cited

U.S. PATENT DOCUMENTS

| | | | | | |
|---|---|---|---|---|---|
| 3,492,748 | A * | 2/1970 | Swenson | F41A 17/00 | 42/70.01 |
| 3,633,303 | A * | 1/1972 | Volkmar | F41A 17/64 | 42/70.06 |
| 4,414,769 | A * | 11/1983 | Mueschke | F41A 35/06 | 42/70.01 |
| 4,590,697 | A * | 5/1986 | Ruger | F41A 17/56 | 42/70.01 |
| 4,681,020 | A * | 7/1987 | Polanecky | F41A 9/62 | 89/138 |

(Continued)

FOREIGN PATENT DOCUMENTS

| | | |
|---|---|---|
| CN | 104154812 A | 11/2014 |
| EP | 0 428 292 A2 | 5/1991 |

(Continued)

OTHER PUBLICATIONS

Search Report issued in European Patent Application No. 19165367.4, dated Jul. 24, 2019.

(Continued)

*Primary Examiner* — Alexander R Niconovich

(74) *Attorney, Agent, or Firm* — Michael Best & Friedrich LLP

(57) ABSTRACT

A toy gun includes: a frame; a trigger; a sear that is interlocked with an action of the trigger; a hammer configured to jet a gas out of a gas cylinder to fire a bullet by interlock with the action of the sear; left and right safety levers installed outside the frame with a gap between the safety levers and the frame. The safety levers can be selectively in contact with or out of contact with the sear. A biasing means provides bias in such a direction as to maintain a gap between the frame and each of the safety levers.

5 Claims, 28 Drawing Sheets

(56) References Cited

U.S. PATENT DOCUMENTS 5,212,327 A * 5/1993 Schuemann ..... F41A 17/32 42/70.01
5,303,494 A * 4/1994 Tuma ..... F41A 17/56 42/70.04
5,711,286 A * 1/1998 Petrosyan ..... F41B 11/55 124/53
5,903,994 A * 5/1999 Tange ..... F41A 11/00 42/70.01
6,112,734 A * 9/2000 Kunimoto ..... F41B 11/721 124/56
6,497,229 B1 * 12/2002 Maeda ..... F41B 11/50 124/73
6,502,568 B2 * 1/2003 Kunimoto ..... F41B 11/723 124/73
6,588,136 B2 * 7/2003 Baker ..... F41A 19/48 42/70.02
8,127,481 B2 * 3/2012 Rozunn ..... F41A 17/00 42/70.01
8,276,502 B1 * 10/2012 Wright ..... F41A 17/46 42/70.01
8,333,028 B1 * 12/2012 Karfiol ..... F41A 17/56 42/70.01
8,499,482 B1 * 8/2013 Di Trolio ..... F41A 17/42 42/70.01
8,549,982 B2 * 10/2013 Troy, Jr. ..... F41A 35/06 89/132
8,806,790 B1 * 8/2014 Huang ..... F41A 17/74 42/70.08
9,057,574 B2 * 6/2015 McClave ..... F41A 17/42
9,857,134 B1 * 1/2018 Karfiol ..... F41A 17/56
10,126,081 B1 * 11/2018 Geissele ..... F41A 17/46
10,126,086 B2 * 11/2018 Smith ..... F41A 35/06
10,466,002 B1 * 11/2019 Geissele ..... F41A 19/02
2005/0064782 A1 * 3/2005 Kunimoto ..... F41B 11/721 446/210
2005/0260545 A1 * 11/2005 Schavone ..... F41B 11/51 434/18
2013/0111796 A1 * 5/2013 Dionne ..... F41A 17/00 42/70.11
2013/0152444 A1 * 6/2013 Tatum ..... F41A 17/56 42/70.05
2014/0259846 A1 * 9/2014 Joubert ..... F41A 17/56 42/70.11
2016/0018176 A1 * 1/2016 Fellows ..... F41A 19/14 42/69.03
2016/0091268 A1 * 3/2016 Miller, III ..... F41A 17/46 42/70.06
2016/0282073 A1 * 9/2016 Ghitti ..... F41A 19/07
2017/0176122 A1 * 6/2017 Underwood ..... F41A 19/46

FOREIGN PATENT DOCUMENTS

JP H10-220993 A 8/1998
WO 2009051872 A1 4/2009
WO WO-2009/147459 A1 12/2009

OTHER PUBLICATIONS

Search Report issued in Taiwan Application No. 108110831, dated Nov. 18, 2019.

* cited by examiner

TOY GUN

CROSS REFERENCE TO RELATED APPLICATION

The present application is based on and claims the benefit of priority of Japanese Patent Application No. 2018-071047 filed on Apr. 2, 2018, the entire contents of which is incorporated herein by reference.

BACKGROUND OF THE INVENTION

Field of the Invention

The present invention relates to a toy gun. The present invention relates in particular to an air gun and in more particular to a safety device (manual safety) used in an air gun.

Description of Related Art

A "safety device of a toy air gun" described in Japanese Unexamined Patent Application Publication No. Hei 10(1998)-220993 (hereinafter referred to as "JP '993") is known as a safety device (manual safety) used in an air gun.

The "safety device of a toy pellet gun" described in JP '993 includes: a hammer supplied by a spring with biasing force for rotation frontward of the gun; a sear locking the hammer as is rotated rearward by a certain angle against the above biasing force; and an impact frame rotatably provided at the tip thereof with an impact hammer. The toy pellet gun is so constructed that by pulling a trigger provided on a gun body, when the hammer raised and locked in advance returns to a predetermined position, a discharge valve of a gas accumulator is opened via the impact hammer and gas is jetted out into a bullet firing passage, thereby a bullet loaded there is fired. In this toy pellet gun, the impact hammer is abutted against the discharge valve in a bullet firing enabled state but the abutment between the impact hammer and the discharge valve is released when bullet firing is aborted.

A manual safety is a manual safety device that may be provided in an automatic hand gun. When a lever (safety lever) provided in the manual safety is rotated to turn on the manual safety (actuate the safety device), the manual safety is engaged with a sear. As a result, a trigger bar directly coupled with a trigger is abutted against the sear and is immobilized and this prevents a hammer from being moved and a bullet from being fired. This mechanism prevents unforeseen accidental firing. This manual safety is adopted in real guns and toy guns imitating a real gun (hereafter, referred to as "toy guns").

Unlike a manual safety of a real gun, a manual safety of a conventional toy guns is, when dropped, rotated by resulting impact and the manual safety is turned off (the safety device is released); therefore, the manual safety used to be inferior in safety.

When a toy gun is marketed in the United States, the toy gun must pass a "drop test" stipulated by a US's rule. One of the stipulations for the "drop test" requires that a manual safety shall not be shifted from on to off due to dropping impact.

In the drop test, a toy gun is dropped from a height of 36 inches in six different directions. The drops in the six different directions include: dropping with the upper part of a gun oriented upward; dropping with the upper part of a gun oriented downward; dropping with a muzzle positioned on the lower side; dropping with a muzzle positioned on the upper side; dropping with the right side of a gun positioned on the upper side; and dropping with the left side of a gun positioned on the upper side.

When a gun is dropped with the right side thereof positioned on the upper side or with the left side thereof positioned on the upper side, that is, when a gun is dropped with a safety lever thereof positioned on the lower side, almost all the weight of the toy gun and dropping impact is exerted on the safety lever. If the safety lever is not locked at this time, the safety lever can be shifted from on to off.

A more specific description will be given. When a conventional toy gun is dropped with a safety lever positioned on the lower side, the safety lever is brought first into contact with the ground because the safety lever is located in the lowest position.

If the spindle of a safety lever is completely vertical when the safety lever is brought first into contact with the ground, the safety will not be moved.

In actuality, however, a gun is rarely dropped with the spindle of a safety lever completely vertical. When a safety lever is brought into contact with the ground, the spindle of the safety lever is usually off vertical and slightly slanted.

At this time, a force vector may be produced in such a direction as to release a safety lever depending on a direction in which the spindle of the safety lever is slanted.

When the magnitude of this force becomes larger than the magnitude of the force holding the safety lever, the safety lever is released.

Consequently, to prevent a manual safety from being accidentally released when the safety lever is on, a conventional toy gun is provided with a component designated as safety unlock button 104, shown in FIG. 39 and the like, to lock the safety lever to prevent the rotation of the manual safety.

Reference numeral 101 denotes a conventional toy gun and 102 denotes a grip portion of the toy gun. Reference numeral 103 denotes a safety lever of the toy gun.

A more specific description will be given. In the conventional toy gun, the safety is unlocked only while the safety unlock button 104 is pressed. For this reason, to switch the safety from on to off, the safety unlock button 104 is pressed to unlock the safety lever 103.

Subsequently, as shown in FIG. 40, the safety lever 103 is pressed down in the direction of the arrow with the safety unlock button 104 held pressed.

That is, to turn off the safety, it is required to rotate the safety lever while pressing down the safety lock.

The safety lever 103 is provided on one side of a frame 1011 located in the center of the conventional toy gun 101. Reference numeral 1031 shown in FIG. 41 and FIG. 42 denotes a safety lever spindle. The safety lever 103 is rotated around the safety lever spindle 1031 as the axis of rotation. Reference numeral 1032 denotes a sear locking portion. By rotating the safety lever 103 to engage the sear locking portion 1032 with a sear 121, the rotation of the sear 121 is locked (the manual safety is on).

Reference numeral 1033 denotes a space, provided in the safety lever 103. The safety lock enters the space when the safety unlock button 104 and the safety are on. Reference numeral 1044 denotes a recess. A safety click for attaching the safety lever 103 to the frame 1011 enters the recess when the safety is off.

In FIG. 46, FIG. 48, and FIG. 51, reference numeral 105 denotes a safety lock and 106 denotes a safety lock spring.

FIG. 43 illustrates a left side sectional view of a toy gun in a conventional example with a safety on; FIG. 44 illustrates a left side perspective view of a trigger, a trigger spring, a trigger bar, a trigger bar spring, a sear, and a hammer of the toy gun in the conventional example; and FIG. 49 illustrates a left side sectional view of the toy gun in the conventional example with the safety off. The conventional toy gun 101 is constructed as shown in these drawings.

A more specific description will be given. Reference numeral 111 denotes the trigger of the conventional toy gun. Reference numeral 112 denotes the trigger spring; 113 denotes the trigger bar; 114 denotes the trigger bar spring (not shown); 115 denotes a trigger bar coupling pin; and 116 denotes a sear pressing portion of the trigger bar.

Reference numeral 121 denotes the sear of the conventional toy gun. Reference numeral 122 denotes the sear spindle; 123 denotes a hammer locking portion of the sear 121; 124 denotes a trigger bar engaging portion of the sear 121; and 125 denotes a safety engaging portion of the sear 121.

Reference numeral 131 denotes the hammer of the conventional toy gun. Reference numeral 132 denotes a hammer spindle; 133 denotes a hammer spring; and 134 denotes a sear engaging portion of the hammer 131.

In the conventional toy gun 101, as shown in FIG. 44, the trigger 111 and the trigger bar 113 are coupled with each other via the trigger bar coupling pin 115. The trigger 111 is biased frontward of the toy gun 101 by the trigger spring 112. When the trigger 111 is pulled, the trigger 111 and the trigger bar 113 can be linearly moved rearward together. In FIG. 44, the trigger bar 113 is biased counterclockwise by the trigger bar spring 114 (not shown).

The sear 121 is rotatable around the sear spindle 122. In FIG. 44, the sear 121 is biased clockwise by the sear spring (not shown).

The hammer 131 is rotatable around the hammer spindle 132. In FIG. 44, the hammer 131 is biased counterclockwise by the hammer spring 133.

As shown in FIG. 43 and FIG. 44, when the manual safety is on, the sear locking portion 1032 of the safety lever 103 and the safety engaging portion 125 of the sear 121 are engaged with each other. For this reason, even when the trigger 111 is pulled, the sear pressing portion 116 of the trigger bar 113 cannot press the trigger bar locking portion of the sear 121.

Since the sear 121 cannot be thus rotated, the hammer 131 is not rotated, either. As a result, a bullet cannot be fired.

As shown in FIG. 45 and FIG. 46, when the manual safety is on and the safety lock 105 is on, in FIG. 46, the safety lock 105 is biased leftward by the safety lock spring 106.

For this reason, in the same drawing, the safety lock 105 is pressing the safety unlock button 104 leftward. The safety unlock button 104 is hooked on the safety lever 103 and is at rest. Since a part of the safety lock 105 is positioned in the safety lever 103, the safety lever 103 does not move in this state.

As shown in FIG. 47 and FIG. 48, with the manual safety on and the safety unlock button 104 pressed, the safety lock 105 is disengaged from the safety lever 103 by pressing the safety unlock button 104. Therefore, the safety lever 103 can be moved.

When the manual safety shown in FIG. 49, FIG. 50, and FIG. 51 is off, the sear locking portion 1032 of the safety lever 103 is not engaged. When the trigger 111 is pulled, therefore, the trigger 111 and the trigger bar 113 are moved rearward of the toy gun 101 as shown in FIG. 44. As a result, the sear pressing portion 116 of the trigger bar 113 can press the trigger bar engaging portion 124 of the sear 121.

When the manual safety is off and the trigger 111 is not pulled, the hammer locking portion 123 of the sear 121 is in engagement and thus the hammer 131 is at rest.

When the trigger 111 is thereafter pulled, the trigger 111 and the trigger bar 113 are linearly moved rearward of the toy gun 101. The sear pressing portion 116 of the trigger bar 113 presses the trigger bar engaging portion 124 of the sear 121.

Since the manual safety is off at this time, the sear locking portion 1032 of the safety lever 103 and the safety engaging portion 125 of the sear 121 are not engaged with each other. Thus, the sear 121 is rotated counterclockwise around the sear spindle 122. As a result, the hammer locking portion 123 of the sear 121 and the sear engaging portion 134 of the hammer 131 are brought out of engagement and the hammer 131 is now rotatable counterclockwise around the hammer spindle 132.

When the hammer 131 is rotated, a hit pin pressing portion 135 of the hammer 131 moves a hit pin 141 frontward of the toy gun 101. The hit pin 141 moves a valve 142 frontward of the toy gun 101.

When the valve 142 is moved frontward of the toy gun 101 and a packing contact portion 143 of the valve 142 and a packing 144 are brought out of contact, gas in a cylinder 151 flows into a gas passage 145 of the valve 142.

When the gas flows into the gas passage 145 of the valve 142, the gas moves a nozzle 161 frontward of the toy gun 101. The nozzle 161 moves a first bullet W into an inner barrel 162. The gas further moves the first bullet W moved into the inner barrel 162 frontward of the toy gun 101.

Thereafter, the action sequentially progresses until a second bullet W is loaded into a firing position.

SUMMARY OF THE INVENTION

A toy gun is implemented such that if the gun is dropped, a manual safety is moved and interferes with a frame within the gun and the manual safety is prevented from being rotated and will not be released.

A toy gun of this invention includes:

a frame provided in the toy gun; a trigger attached to the toy gun; a sear interlocked with the action of the trigger; a hammer jetting gas out of a cylinder to fire a bullet by interlock with the action of the sear; a safety lever installed outside the frame with a gap between the safety lever and the frame and can be selectively in contact with or out of contact with any member of the trigger to the hammer interlocked with one another, that is, at least one member selected from members composing the configuration of the trigger to the hammer interlocked with one another; and a biasing means providing bias in such a direction as to maintain a gap between the frame and the safety lever. Any member of the trigger to the hammer interlocked with one another may be a sear. The safety lever may be provided on both sides of the frame.

BRIEF DESCRIPTION OF THE DRAWINGS

FIG. 1 is a left side view of a toy gun in an implementation of an embodiment of the present invention with a safety on;

FIG. 2 is a right side view of a toy gun in an implementation of an embodiment of the present invention with a safety on;

FIG. 17 is a partial enlarged view of a safety lever of a toy gun in an implementation of an embodiment of the present invention with a safety on;

FIG. 19 is a partial enlarged view of a left side face of a toy gun in an implementation of an embodiment of the present invention with a safety on;

FIG. 21 is a partial enlarged view of a right side face of a toy gun in an implementation of an embodiment of the present invention with a safety on;

FIG. 22 is a plan view of a safety lever left, a safety lever right, a sear, and a hammer of a toy gun in an implementation of an embodiment of the present invention with a safety on;

FIG. 25 is a partial enlarged view of a safety lever left moved inward of a toy gun in an implementation of an embodiment of the present invention with a safety on;

FIG. 27 is a partial enlarged view of a left side face of a safety lever left moved inward of a toy gun in an implementation of an embodiment of the present invention with a safety on;

FIG. 29 is a partial enlarged view of a safety lever right moved inward of a toy gun in an implementation of an embodiment of the present invention with a safety on;

FIG. 39 is a left side view of a toy gun in a conventional example with a safety lever on and a safety lock on;

FIG. 43 is a left side sectional view of a toy gun in a conventional example with a safety on;

FIG. 45 is a partial enlarged view of a left side face of a toy gun in a conventional example with a safety on and a safety lock on;

DETAILED DESCRIPTION OF THE PREFERRED EMBODIMENTS

Figure 1:
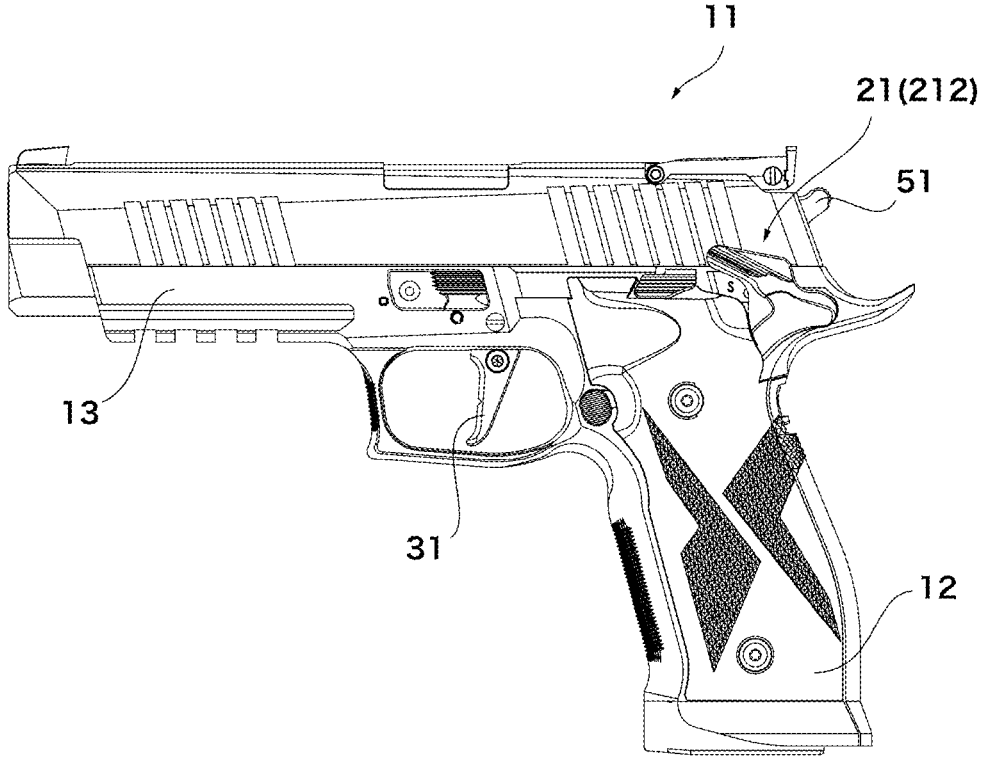

Since a safety lock is a component that is not provided in a real gun, a toy gun provided with a safety lock may impair similarity to a real gun in appearance. Since the commercial value of a toy gun depends on similarity to a real gun in appearance, it is undesirable to provide such a component as a safety lock. Further, an operating method for a toy gun may be different from that for a real gun and this can impair its commercial value. The present invention has been made to make the appearance and shape of and an operating method for a toy gun similar to those of a real gun.

It is an object of the present invention to provide a manual safety device provided in a toy gun which device ensures safety without providing such a component as a safety lock and in which, with a manual safety on, the manual safety will not be turned off due to impact even if the toy gun is dropped.

To do this, a toy gun is implemented such that if the gun is dropped, a manual safety is moved and interferes with a frame within the gun and the manual safety is prevented from being rotated and will not be released.

According to the present invention, a toy gun in which similarity to a real gun in appearance, operating method, and the like will not be impaired and a safety device will not be released even when dropped during a test or the like can be implemented. As a result, the commercial value of the toy gun can be enhanced.

A description will be given to an implementation of an embodiment of the present invention with reference to drawings illustrating implementations of the present invention.

FIG. 1, FIG. 2, FIG. 3, and FIG. 4 illustrate the appearance of the implementation. Reference numeral 11 denotes a toy gun. Reference numeral 12 denotes a grip portion of the toy gun 11. The toy gun 11 is provided in the center thereof with a frame 13 which is a component constituting a skeleton framework of the toy gun.

Reference numeral 21 denotes a safety lever. The safety lever 21 is comprised of a safety lever right 211 and a safety lever left 212. The safety lever 21 is a body of a manual safety and the safety lever right 211 and the safety lever left 212 are attached to the upper part of the grip portion 12 with the frame 13 in between.

Figure 5:
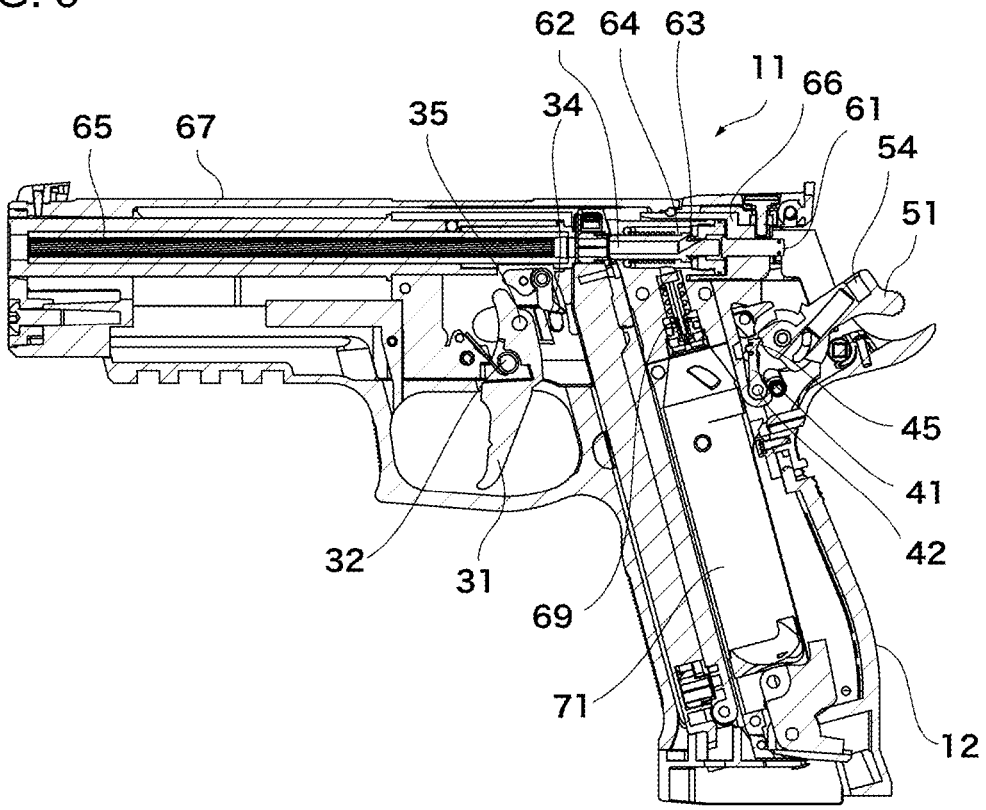
FIG. 5 is a left side sectional view of a toy gun in an implementation of an embodiment of the present invention with a safety off.
Figure 6:
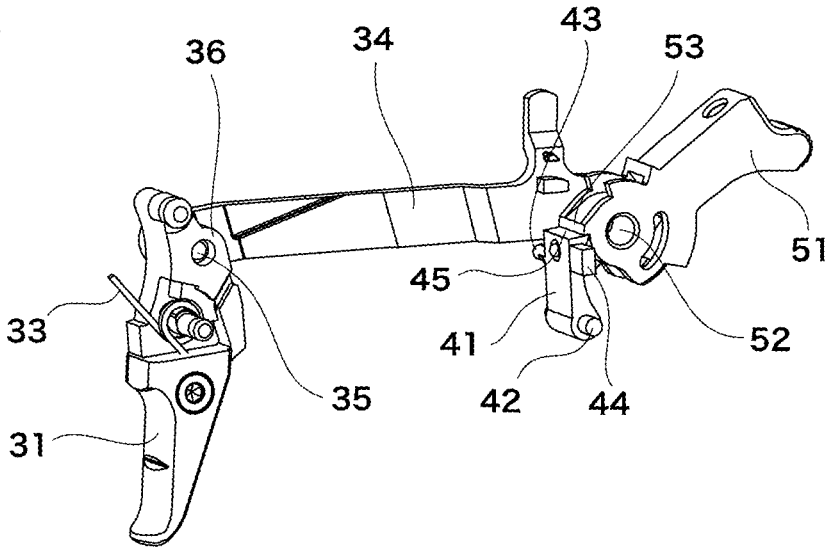
FIG. 6 is a right side perspective view of a toy gun in an implementation of an embodiment of the present invention, illustrating a trigger, a trigger spring, a trigger bar, a sear, and a hammer.
Figure 7:
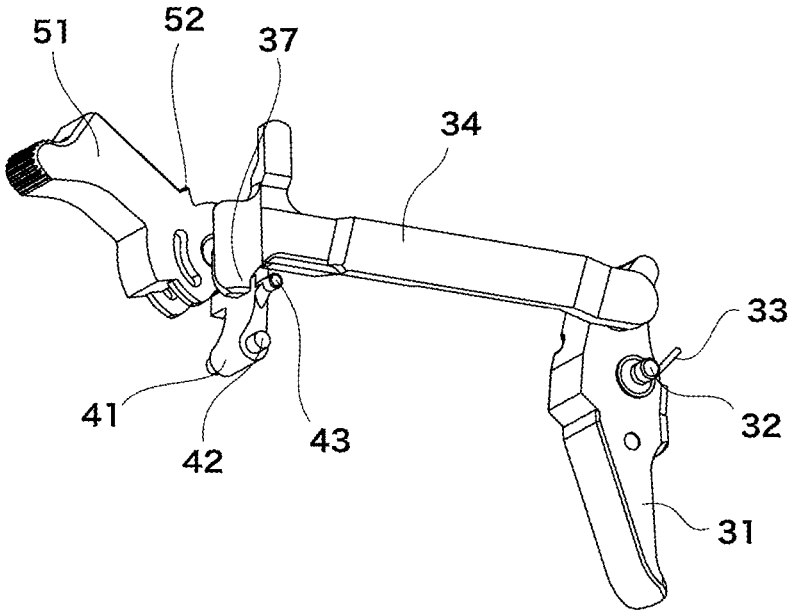
FIG. 7 is a left side perspective view of a toy gun in an implementation of an embodiment of the present invention, illustrating a trigger, a trigger spring, a trigger bar, a sear, and a hammer.

In the implementation of the present invention, an actuation system in connection with the action of a trigger 31 to that of a hammer 51 has an internal structure shown in FIG. 5, FIG. 6, and FIG. 7. Reference numeral 31 denotes the trigger; 32 denotes a trigger spindle; and 33 denotes a trigger spring. The trigger spring 33 is formed of a torsion spring.

The trigger 31 is rotatable around the trigger spindle 32 and is biased counterclockwise by the trigger spring 33 in FIG. 7.

Reference numeral 34 denotes a trigger bar. As shown in FIG. 6, the trigger bar 34 is coupled with the trigger 31 by a trigger bar spindle 35 located above the trigger 31 getting into a trigger bar spindle receiving portion 36 of the trigger 31. Reference numeral 37 is a sear pressing portion provided at the tip of the trigger bar 34.

When the trigger 31 is pulled, the trigger bar 34 is moved frontward of the toy gun 11 (muzzle side, left side in FIG. 7).

Figure 12:
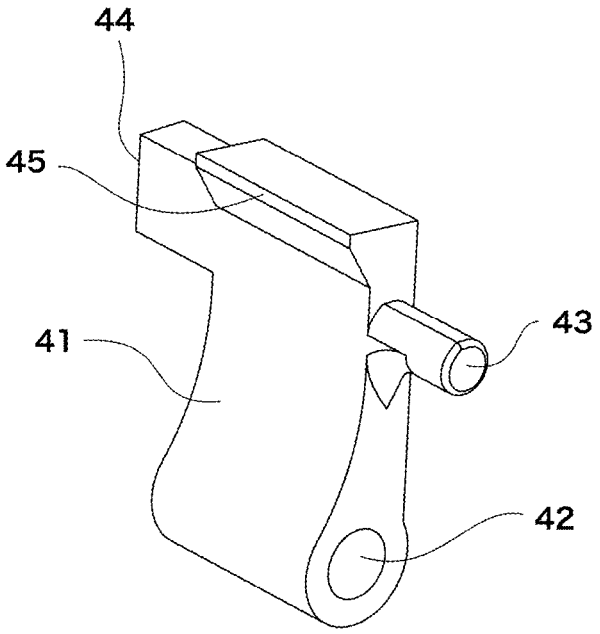
FIG. 12 is a perspective view of a sear unit of a toy gun in an implementation of an embodiment of the present invention.

In FIG. 12, FIG. 6, FIG. 7, and the like, reference numeral 41 denotes a sear. Reference numeral 42 denotes a sear spindle; 43 denotes a trigger bar engaging portion-safety lever right engaging portion; 44 denotes a safety lever left engaging portion; and 45 denotes a hammer locking portion.

The sear spindle 42 is attached to the sear 41 at a right angle to the direction of a barrel, that is, to a body of the toy gun 11 in the width direction of the toy gun 11. Above the sear 41, the hammer locking portion 45 is provided in the center and the safety lever left engaging portion 44 and the trigger bar engaging portion-safety lever right engaging portion 43 are provided on the both sides thereof.

The sear 41 is attached to the body of the toy gun 11 so as to be rotatable around the sear spindle 42 and is biased counterclockwise by a sear spring (not shown) in FIG. 7.

Figure 23:
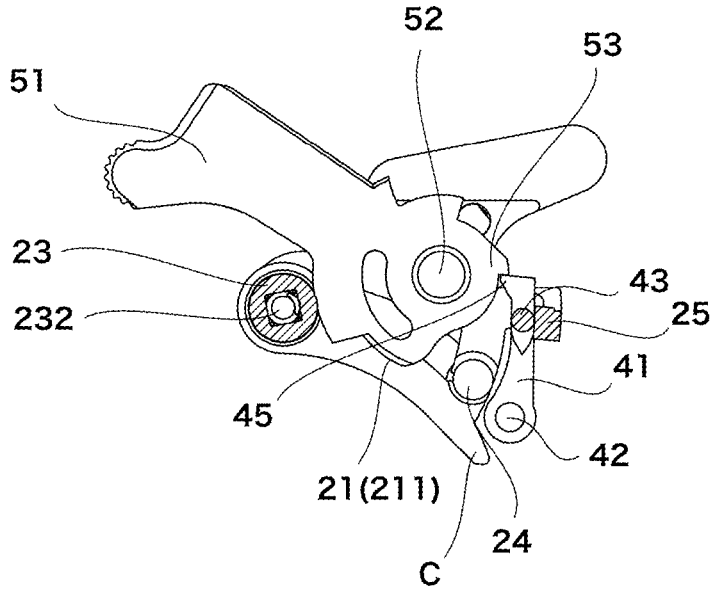
FIG. 23 is a right side sectional view of a safety lever left, a safety lever right, a sear, and a hammer of a toy gun in an implementation of an embodiment of the present invention with a safety on, taken along line AA of FIG. 22.

When the trigger 31 is pulled, the trigger bar engaging portion-safety lever right engaging portion 43 is engaged with the sear pressing portion 37 of the trigger bar 34. When the safety is on, as shown in FIG. 23, the trigger bar engaging portion-safety lever right engaging portion is engaged with the sear locking portion 25 of the safety lever right 211.

Reference numeral 51 denotes a hammer. The hammer 51 is rotatably attached to the trigger bar 34 via the hammer spindle 52. The hammer 51 is rotatable around the hammer spindle 52 and is biased counterclockwise by a hammer spring (not shown) in FIG. 7. The actuation of the hammer 51 causes gas in a cylinder to flow into a gas passage. Reference numeral 54 shown in FIG. 5 denotes a hit pin pressing portion provided on the muzzle side of the hammer 51.

In FIG. 6, FIG. 23, FIG. 24, FIG. 37, and FIG. 38, reference numeral 53 denotes a sear engaging portion provided at the muzzle-side tip of the hammer 51.

As shown in FIG. 6, FIG. 23, FIG. 24, FIG. 37, and FIG. 38, the sear 41 is abutted against the sear engaging portion 53 of the hammer 51 at the hammer locking portion 45 of the sear 41 and is engaged with the hammer 51.

Figure 24:
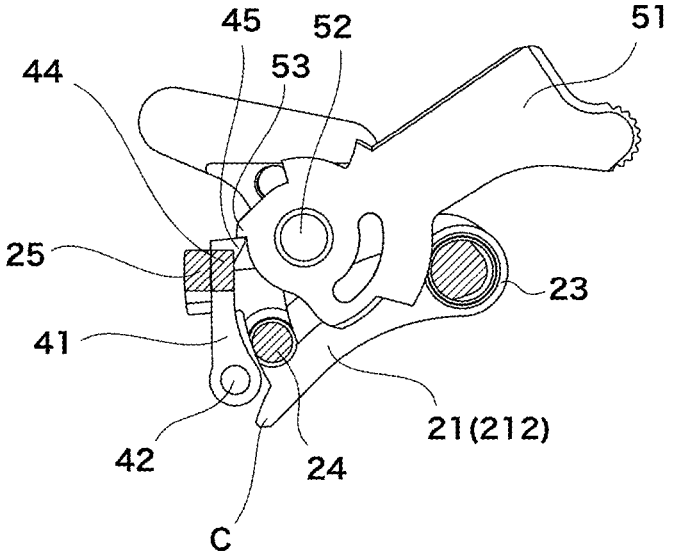
FIG. 24 is a left side sectional view of a safety lever left, a safety lever right, a sear, and a hammer of a toy gun in an implementation of an embodiment of the present invention with a safety on, taken along line BB of FIG. 22.

As shown in FIG. 24, the safety lever left engaging portion 44 of the sear 41 is engaged with the sear locking portion 25 of the safety lever left 212 when the safety is on.

A description will be given to a structure of the manual safety.

A safety lever of a real gun on which the toy gun 11 in an implementation of the present invention is based is located on both the left and right sides of the gun. For this reason, as shown in FIG. 1 to FIG. 4, also in the toy gun 11 in the implementation of the present invention, the safety lever 21 is provided on both the left and right sides as viewed from the muzzle side and is comprised of the safety lever right 211 and the safety lever left 212. Left and right cited here refer to left and right as the toy gun is viewed from the rear end of the gun.

Figure 2:
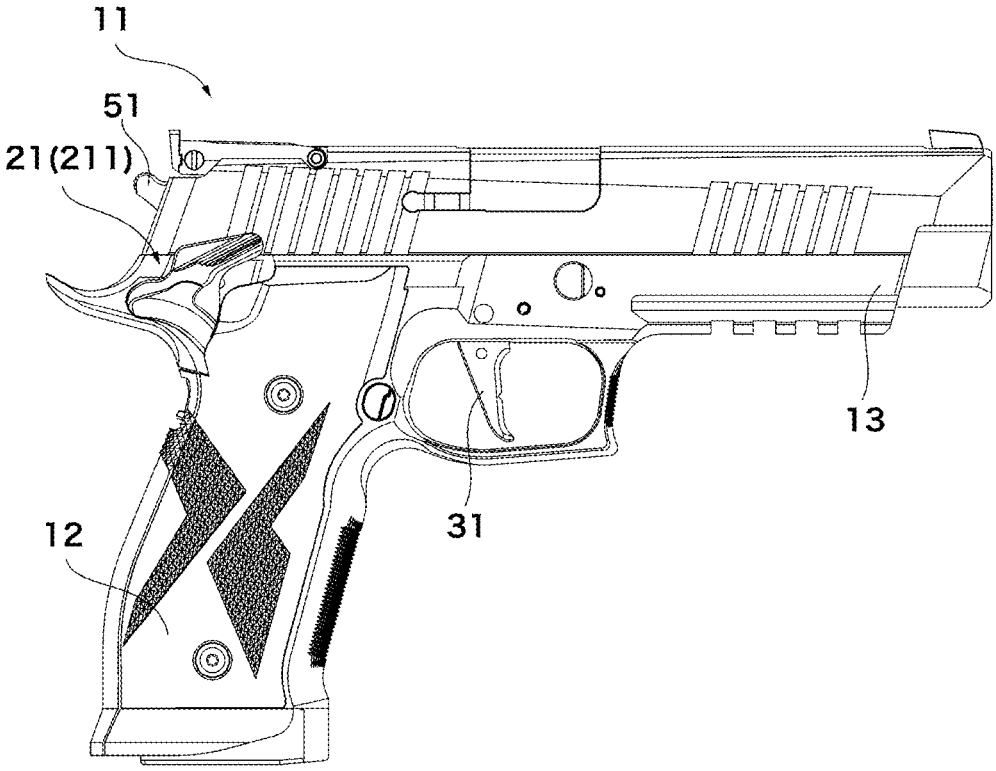

In the implementation shown in FIG. 1 and FIG. 2, in the initial state, the safety lever 21 including both the safety lever right 211 and the safety lever left 212 is in a state in which the safety is actuated (safety on state).

Figure 3:
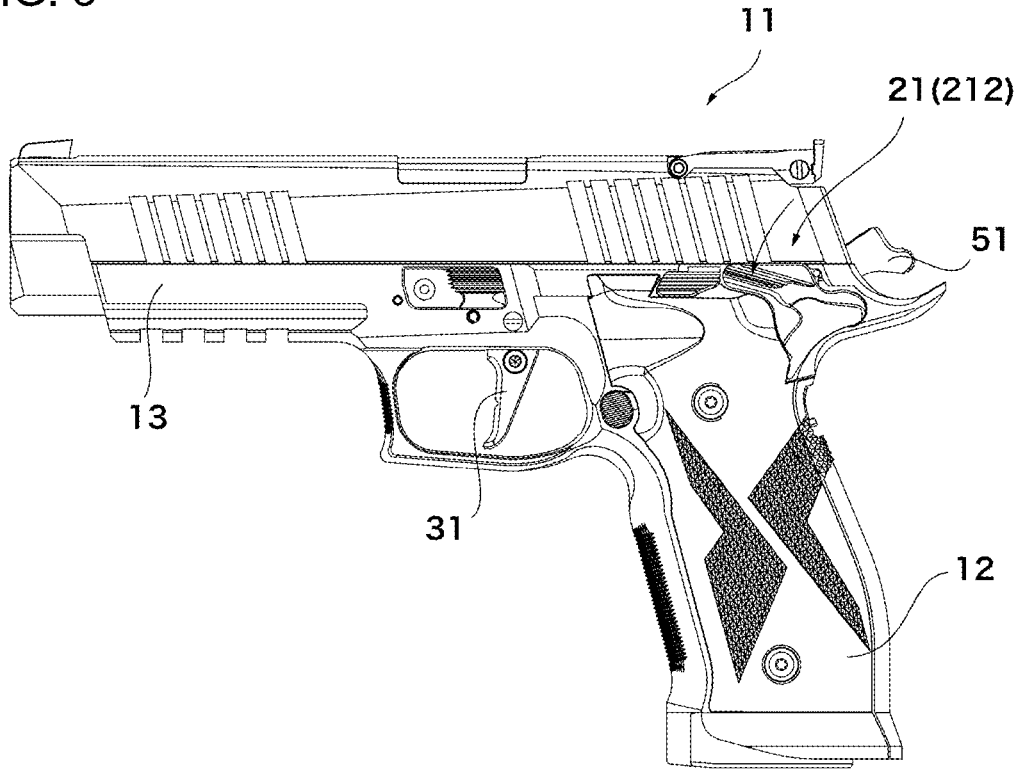
FIG. 3 is a left side view of a toy gun in an implementation of an embodiment of the present invention with a safety off.
Figure 4:
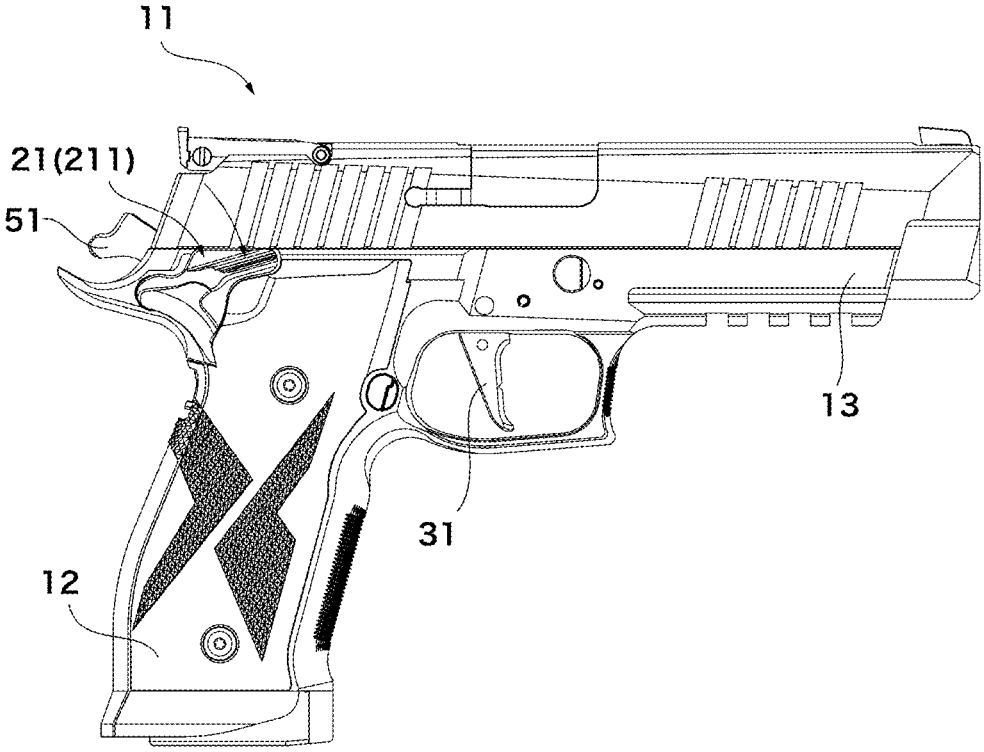
FIG. 4 is a right side view of a toy gun in an implementation of an embodiment of the present invention with a safety off.

To release the manual safety to establish a state in which a bullet can be fired (to turn off the safety), as shown in FIG. 3 and FIG. 4, the safety lever 21 including both the safety lever right 211 and the safety lever left 212 only has to be pressed down with a finger to rotate the safety lever downward.

This operating method is identical with that for a real gun and similarity to a real gun is enhanced as compared with conventional toy guns.

Figure 8:
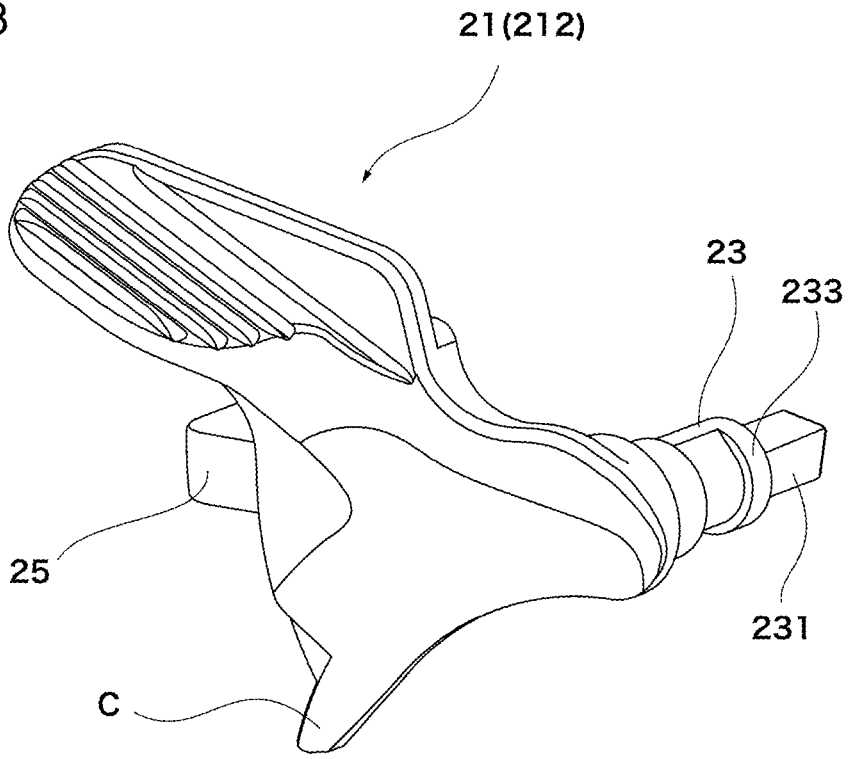
FIG. 8 is a front side perspective view of a safety lever left unit of a toy gun in an implementation of an embodiment of the present invention.
Figure 9:
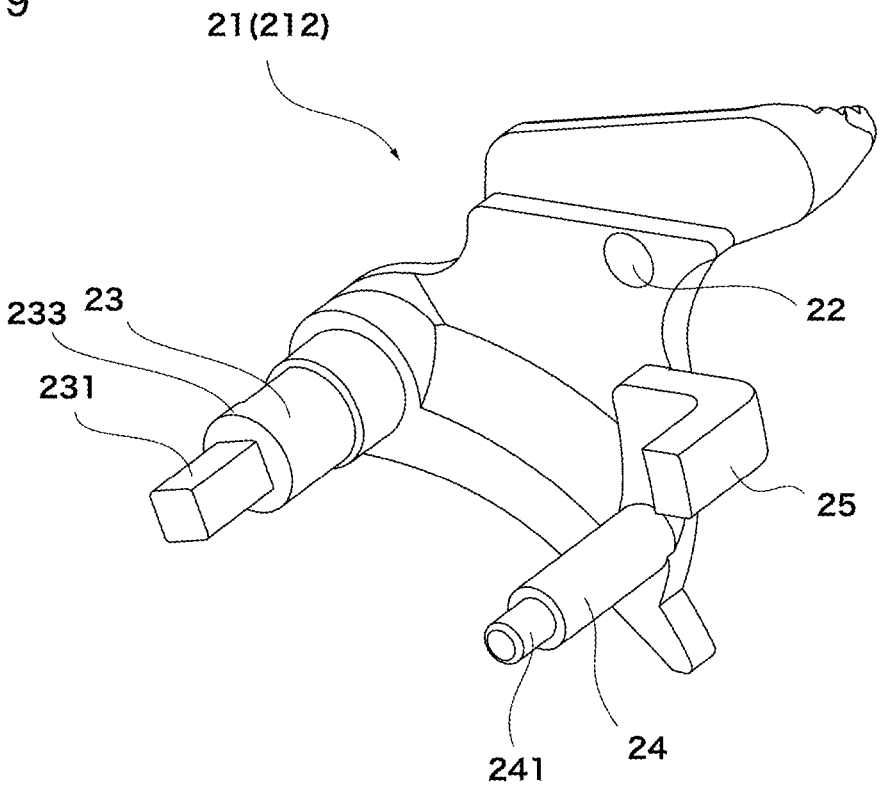
FIG. 9 is a rear side perspective view of a safety lever left unit of a toy gun in an implementation of an embodiment of the present invention.
Figure 10:
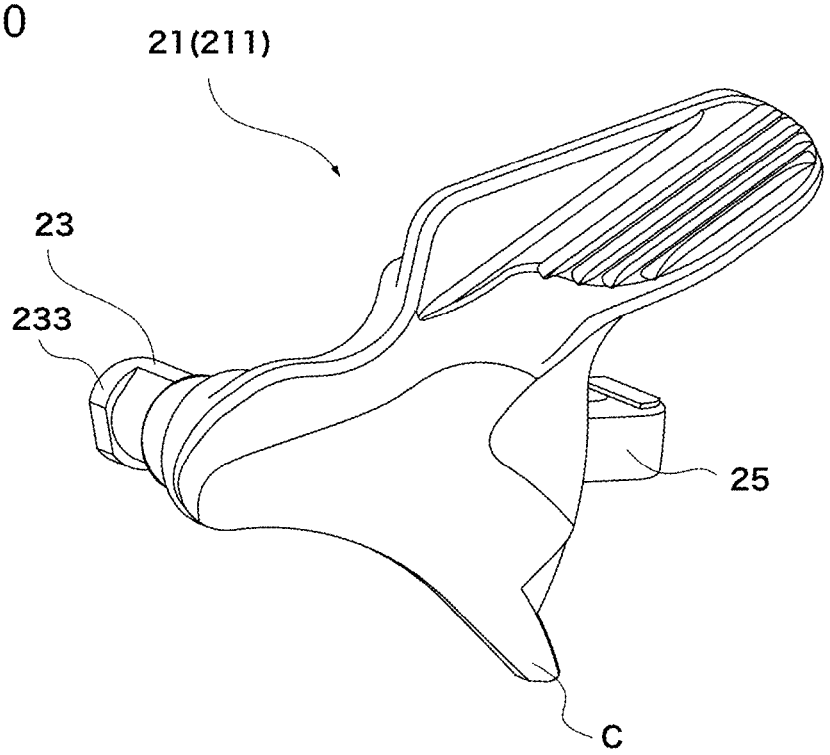
FIG. 10 is a front side perspective view of a safety lever right unit of a toy gun in an implementation of an embodiment of the present invention.
Figure 11:
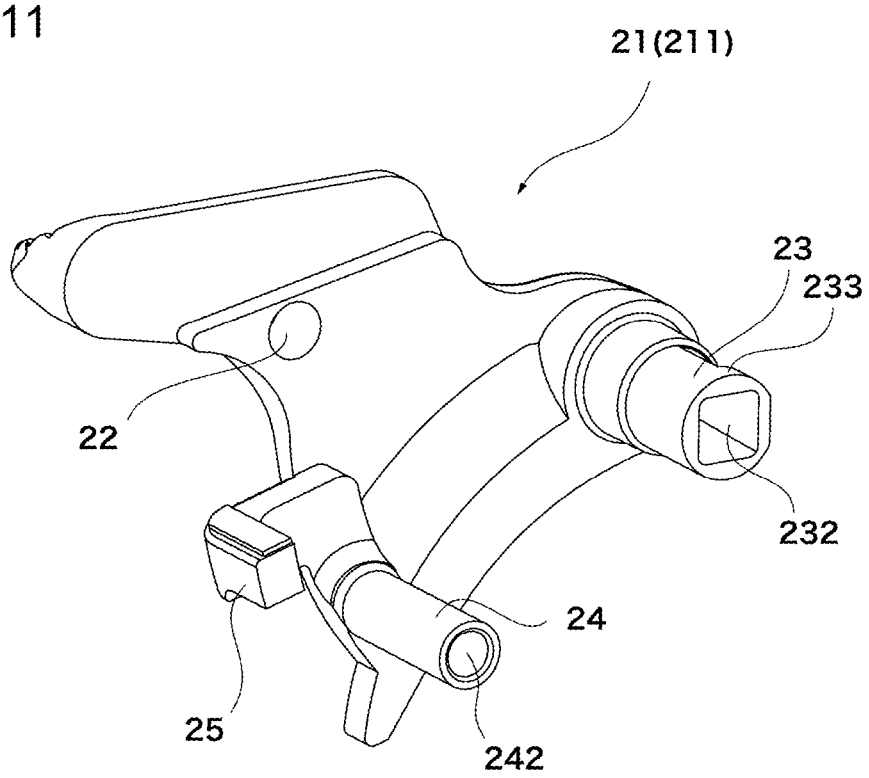
FIG. 11 is a rear side perspective view of a safety lever right unit of a toy gun in an implementation of an embodiment of the present invention.

As shown in FIG. 8 to FIG. 11 and FIG. 13, major components of the safety lever 21 are the safety lever left 212 unit shown in FIG. 8 depicting the front side and FIG. 9 depicting the back side and the safety lever right 211 unit shown in FIG. 10 depicting the front side and FIG. 11 depicting the back side.

Reference numeral 22 shown in FIG. 9 and FIG. 11 denotes a recess for safety click. The recess 22 for safety click is formed to be a recess shape at the upper part of the back side of the safety lever 21 including the safety lever right 211 and the safety lever left 212.

Figure 13:
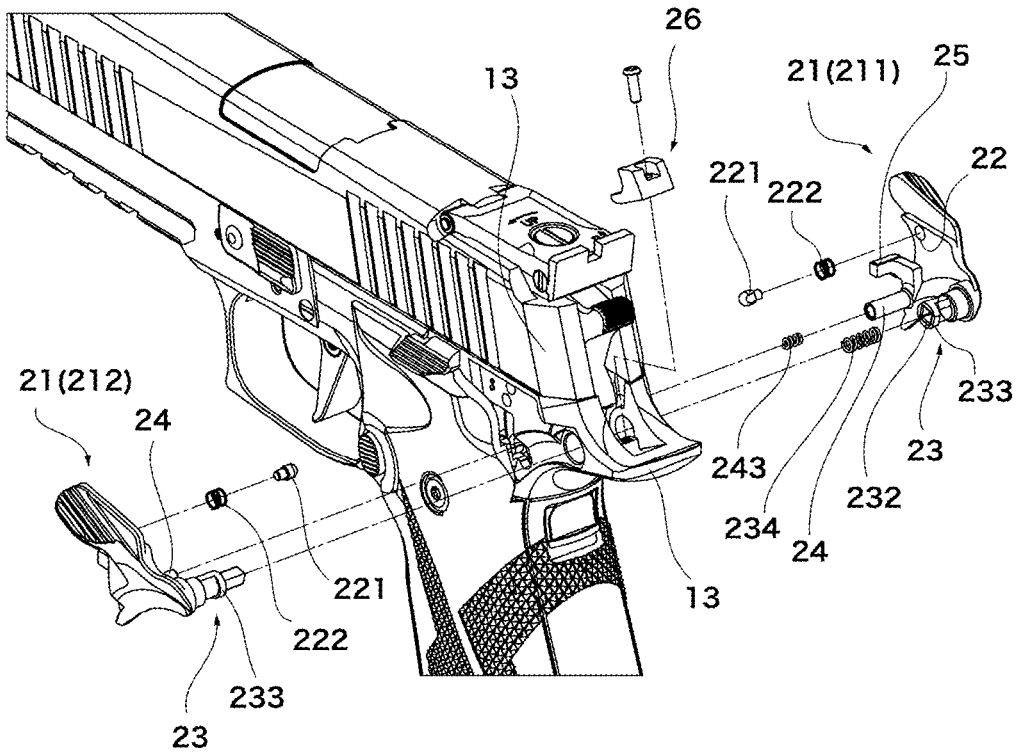
FIG. 13 is a component development of a safety portion of a toy gun in an implementation of an embodiment of the present invention.

As shown in FIG. 13, the recess 22 for safety click accommodates a safety click 221 and a safety click spring 222. The safety click spring 222 biases the safety lever right 211 and the safety lever left 212 outward of the toy gun 11 respectively in opposite directions.

In FIG. 9, FIG. 11, and the like, reference numeral 23 denotes a safety lever spindle. Reference numeral 24 denotes a safety guide. The safety guide 24 couples the safety lever right 211 and the safety lever left 212 with each other.

In FIG. 9, FIG. 11, FIG. 23, FIG. 24, FIG. 37, FIG. 38, and the like, reference numeral 25 denotes a sear locking portion. The sear locking portion 25 is provided above the vicinity of the bases of the safety lever right 211 and the safety lever left 212 on the left and right sides of the safety guide 24. The sear locking portion 25 locks the trigger bar engaging portion-safety lever right engaging portion 43 and safety lever left engaging portion 44 of the sear 41 when the manual safety is on.

Reference sign C denotes a contact portion. The contact portion C is provided inside the lower end of the safety lever 21.

In this implementation of the present invention, a safety lever spindle projection 231 and a safety guide projection 241 of the safety lever left 212 are inserted into a safety lever spindle recess 232 and a safety guide recess 242 of the safety lever right 211 to assemble them together. As the result of this assembly, the safety lever right 211 and the safety lever left 212 are paired and assembled together and the safety lever spindle 23 and the safety guide 24 are respectively integrally assembled.

In the shape of this implementation, the safety lever spindle 23 and the safety guide 24 are integrally assembled. Therefore, when the safety lever 21 is operated by either the safety lever right 211 or the safety lever left 212, the safety lever on the opposite side is also moved in conjunction therewith.

For example, when the safety lever left 212 located on the left side is pressed down, the safety lever right 211 located on the right side is similarly rotated downward.

Figure 14:
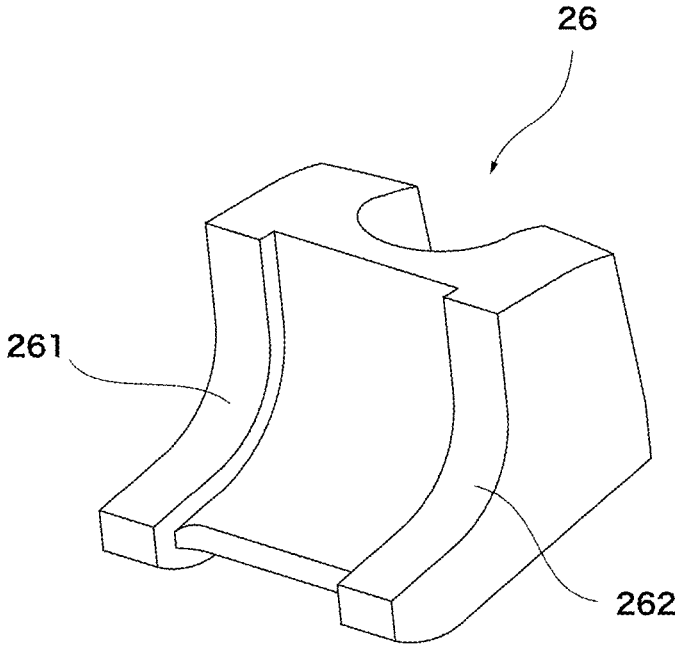
FIG. 14 is a rear side perspective view of a safety hook of a toy gun in an implementation of an embodiment of the present invention.
Figure 15:
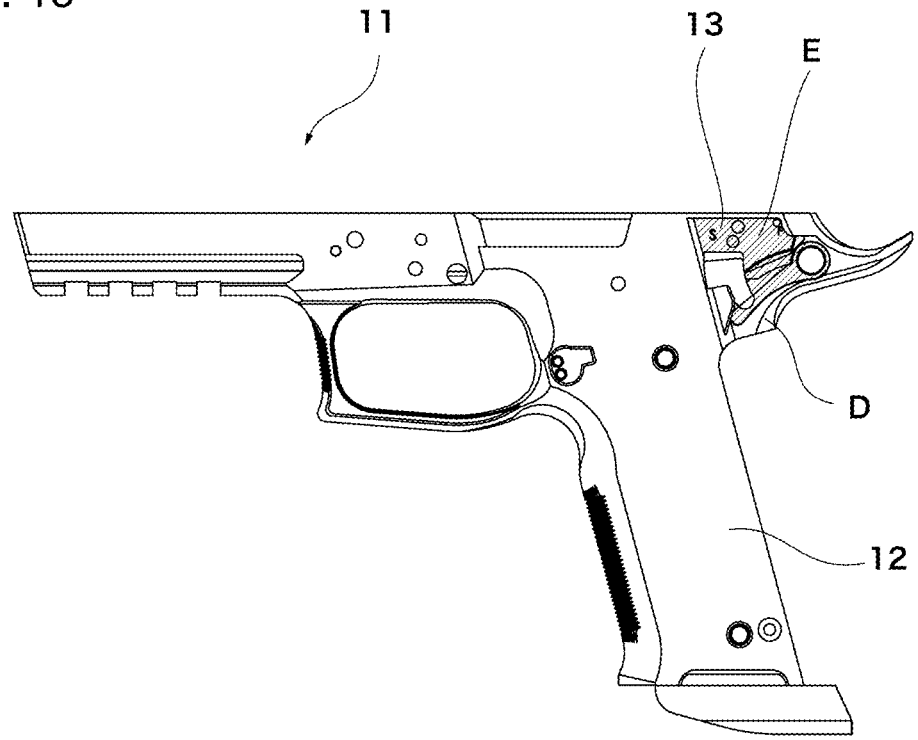
FIG. 15 is a left side view of a frame of a toy gun in an implementation of an embodiment of the present invention.
Figure 16:
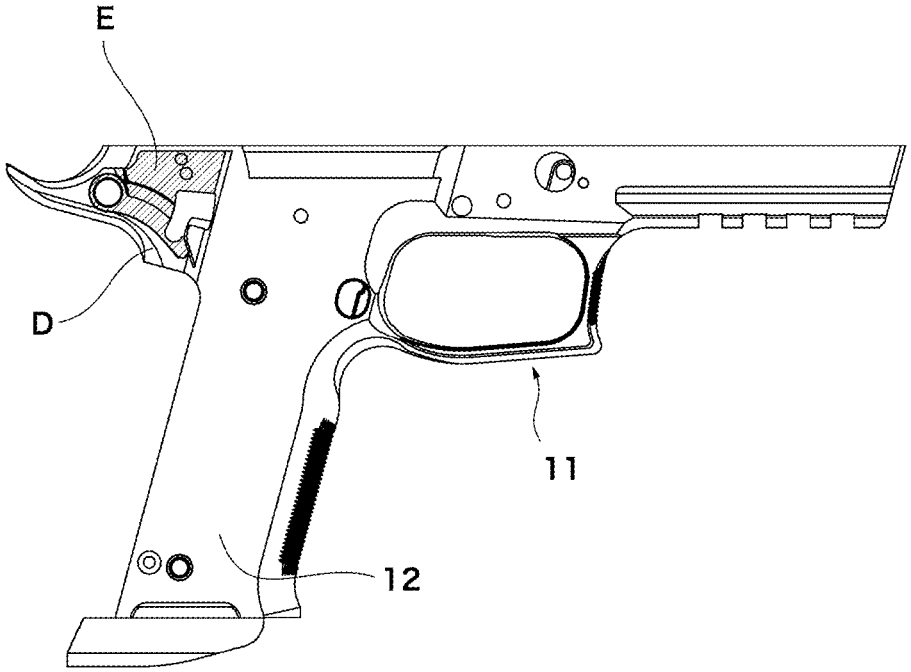
FIG. 16 is a right side view of a frame of a toy gun in an implementation of an embodiment of the present invention.
Figure 17:
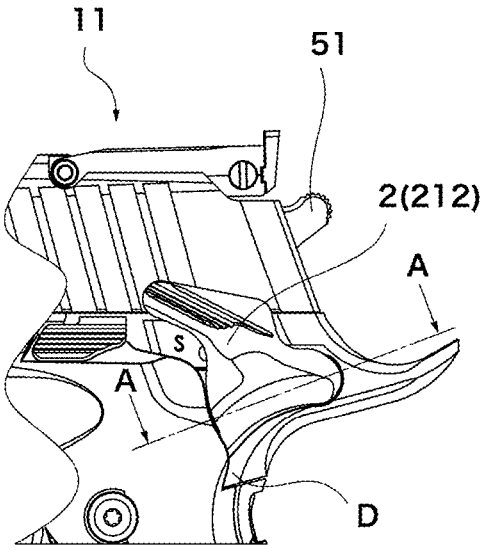

Reference numeral 26 shown in FIG. 14 denotes a safety hook. The safety hook 26 includes a safety lever right locking portion 261 and a safety lever left locking portion 262. The safety lever right locking portion 261 and the safety lever left locking portion 262 are projected from the inner portion of the safety hook 26.

The safety hook 26 is provided on the frame 13 of the body of the toy gun 11.

Each of the left and right safety lever spindles 23 is provided with an locking portion comprised of a safety hook engaging portion 233 and can be engaged with the safety hook 26.

A more specific description will be given. In FIG. 8 to FIG. 11 and FIG. 18, reference numeral 233 denotes the safety hook engaging portion. As shown in the drawings, the safety hook engaging portion 233 is provided in the respective safety lever spindles 23 of the safety lever right 211 and the safety lever left 212. Since the safety lever left locking portion 262 of the safety hook 26 and the safety hook engaging portion 233 of the safety lever left 212 are engaged with each other, the safety lever left 212 is prevented from further moving outward of the toy gun 11.

This is also the case with the safety lever right 211. Since the safety lever right locking portion 261 of the safety hook 26 and the safety hook engaging portion 233 of the safety lever right 211 are engaged with each other, the safety lever right 211 is prevented from further moving outward of the toy gun 11.

Figure 18:
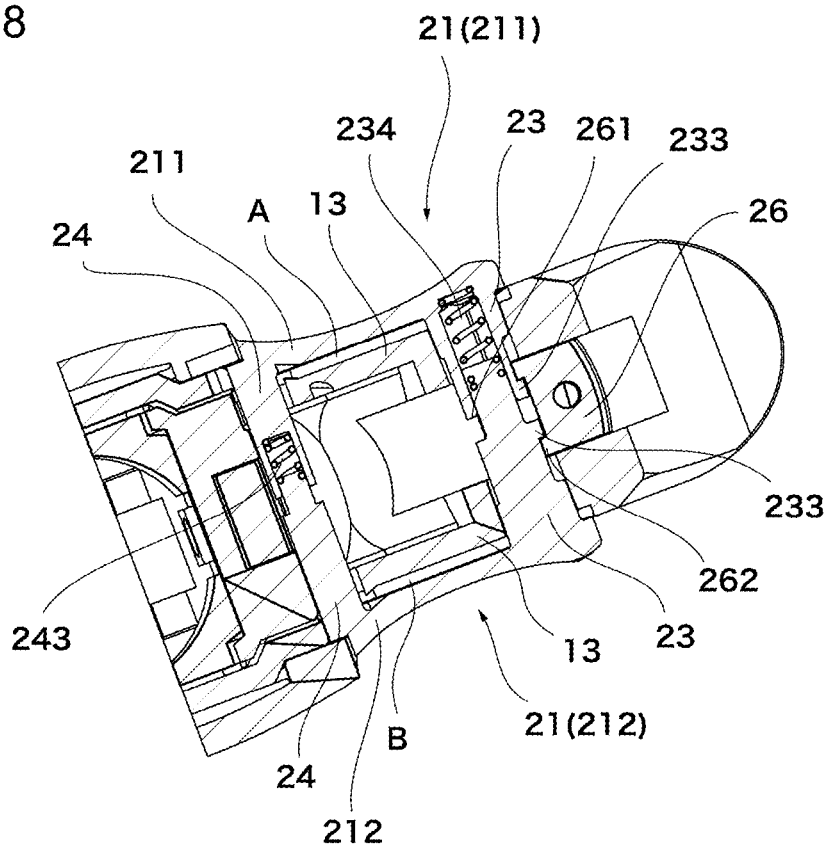
FIG. 18 is an enlarged sectional view of a toy gun in an implementation of an embodiment of the present invention, taken along line AA of FIG. 17.
Figure 19:
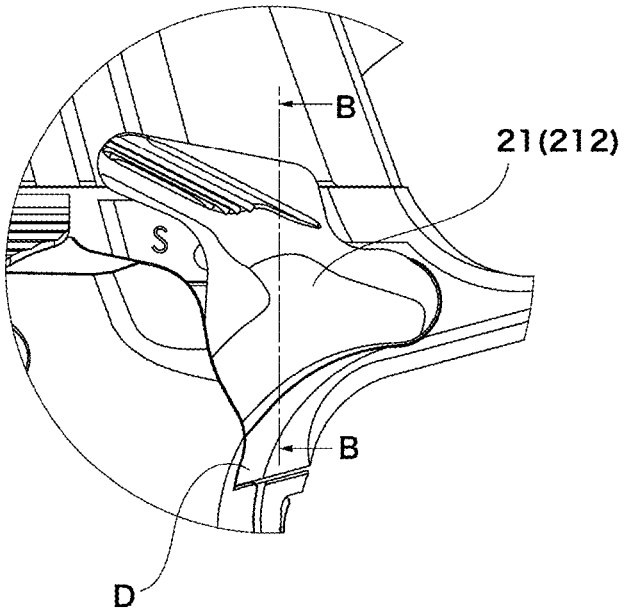

As shown in FIG. 13 and FIG. 18, a safety lever spindle spring 234 as a biasing means is put into the safety lever spindle 23 of the safety lever right 211. The safety lever spindle spring 234 biases the safety lever left 212 and the safety lever right 211 outward of the toy gun 11 respectively in opposite directions.

Reference numeral 243 denotes a safety guide spring as a biasing means. The safety guide spring 243 is put into the safety guide 24 of the safety lever right 211. The safety guide spring 243 biases the safety lever left 212 and the safety lever right 211 outward of the gun respectively in opposite directions.

A more specific description will be given. The safety lever spindle spring 234 as a biasing means and the safety guide spring 243 as a biasing means bias the safety lever left 212 and the safety lever right 211 outward of the gun respectively in opposite directions.

For this purpose, a space A is provided between the frame 13 and the safety lever right 211; and a space B is provided between the frame 13 and the safety lever left 212.

Figure 20:
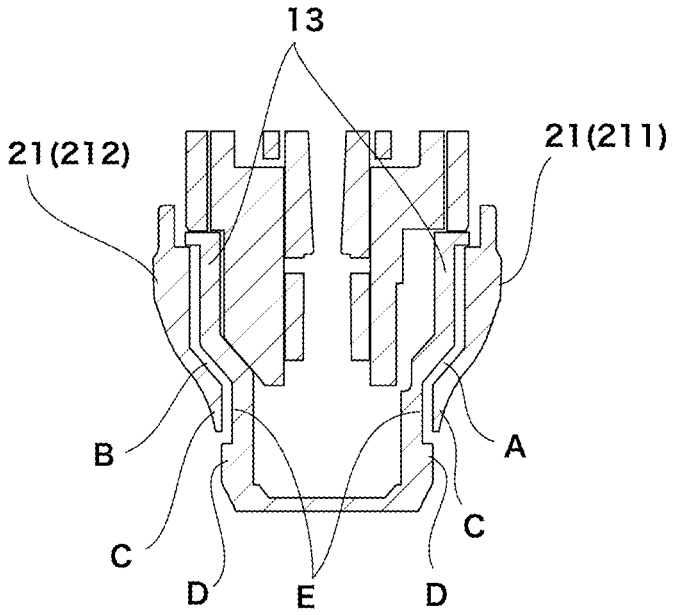
FIG. 20 is a partial enlarged sectional view of a toy gun in an implementation of an embodiment of the present invention with a safety on, taken along line BB of FIG. 19.
Figure 21:
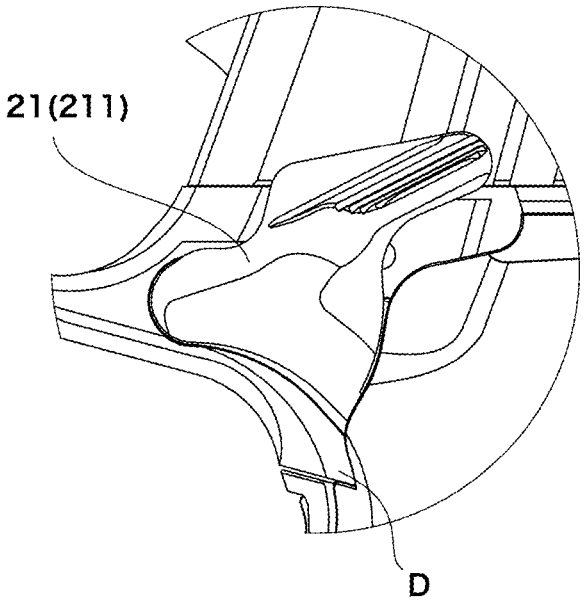
Figure 22:
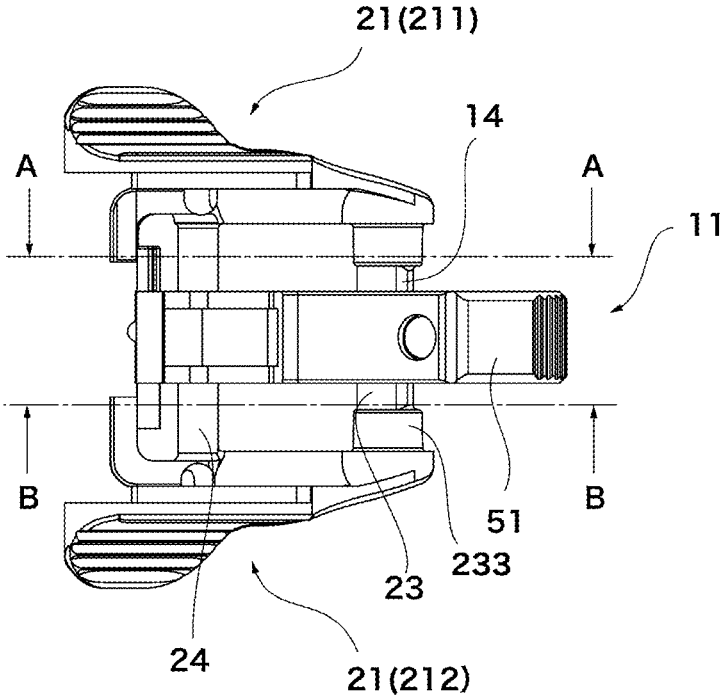

As shown in FIG. 20, the frame 13 is provided with a projection D located below the space A and space B portions and projected from the faces of the frame 13 facing the space A and the space B.

When force greater than those of the safety lever spindle spring 234 and the safety guide spring 243 is applied to the safety lever left 212 or the safety lever right 211 from outside to inside the toy gun 11 with the safety on, as shown in FIG. 18, the safety lever left 212 or the safety lever right 211 can be moved inward of the gun.

Owing to this mechanism, when the toy gun 11 is dropped and the safety lever 21 collides with the ground, the safety lever 21 is moved inward of the toy gun 11. That is, the safety lever 21 is retracted.

Figure 25:
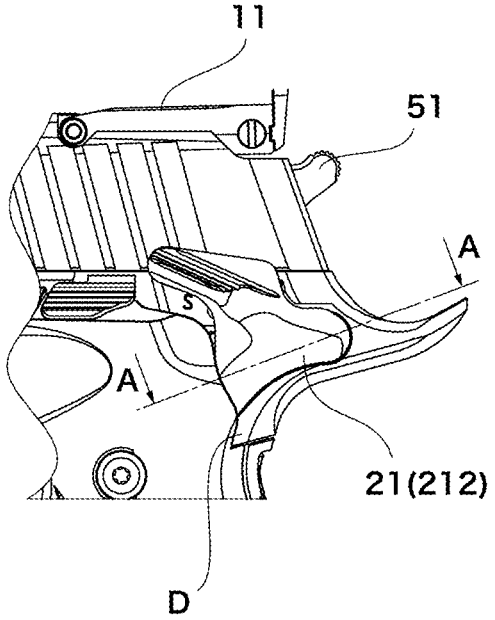
Figure 26:
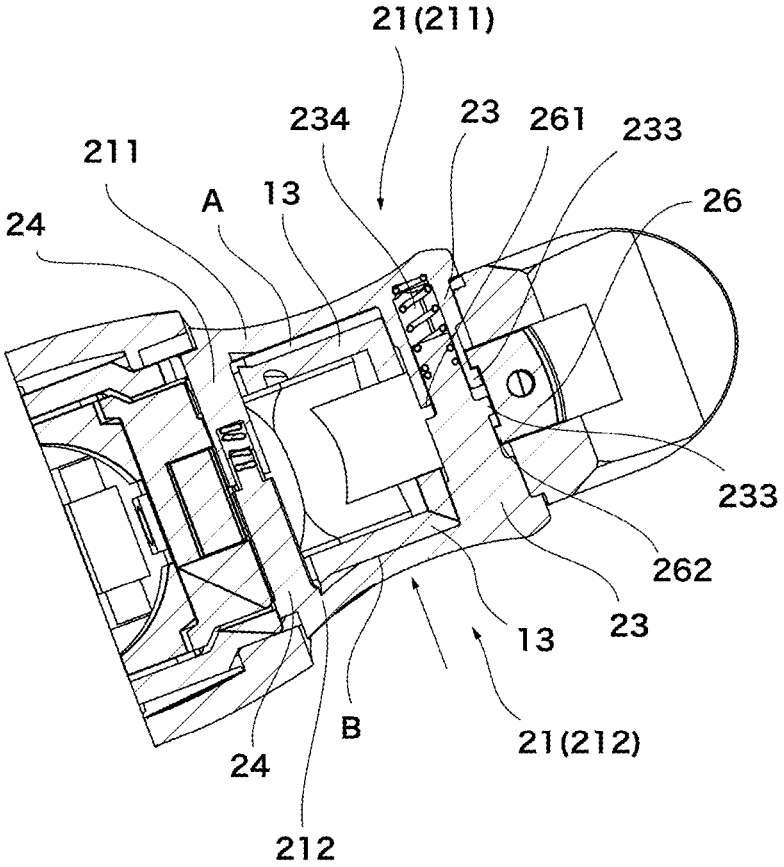
FIG. 26 is a partial enlarged sectional view of a safety lever left moved inward of a toy gun in an implementation of an embodiment of the present invention with a safety on, taken along line AA of FIG. 25.
Figure 27:
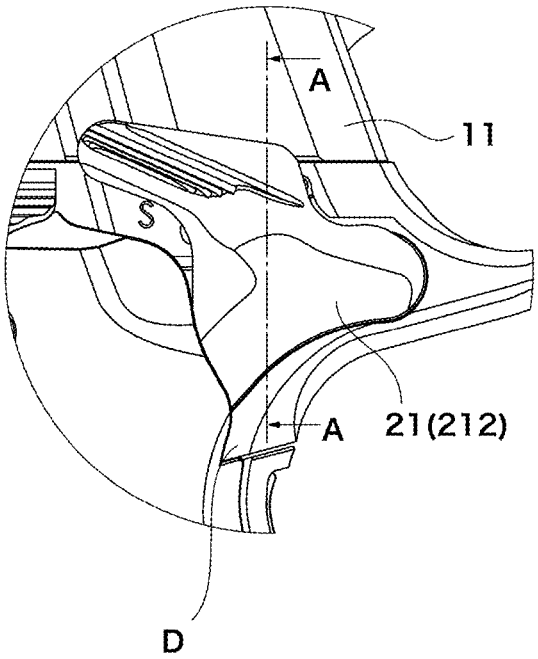

For example, as shown in FIG. 25 and FIG. 26, when the toy gun 11 is dropped with the left side thereof oriented downward as indicated by the arrow in FIG. 26 with the safety on, the weight of the toy gun 11 and the dropping impact are exerted on the safety lever left 212. Even if the gun is dropped and the safety lever left 212 collides with the ground with the safety working, that is, the safety lever 21 on, as shown in FIG. 26, the safety lever left 212 is moved inward of the toy gun 11.

The space A between the frame 13 and the safety lever right 211 remains but the space B between the frame 13 and the safety lever left 212 is eliminated.

Figure 29:
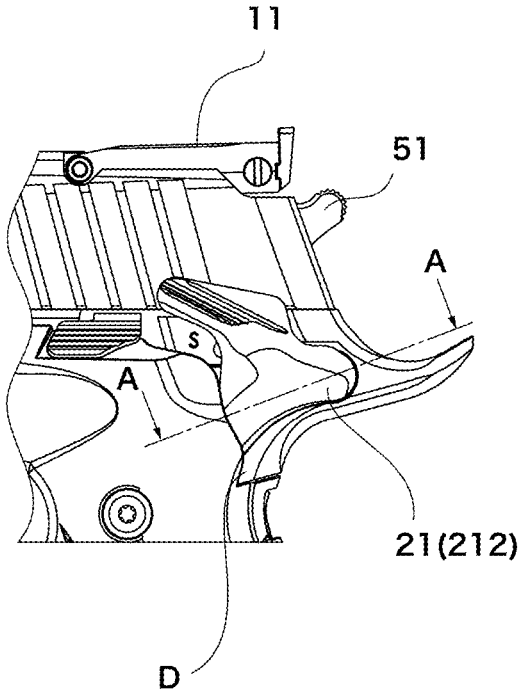
Figure 30:
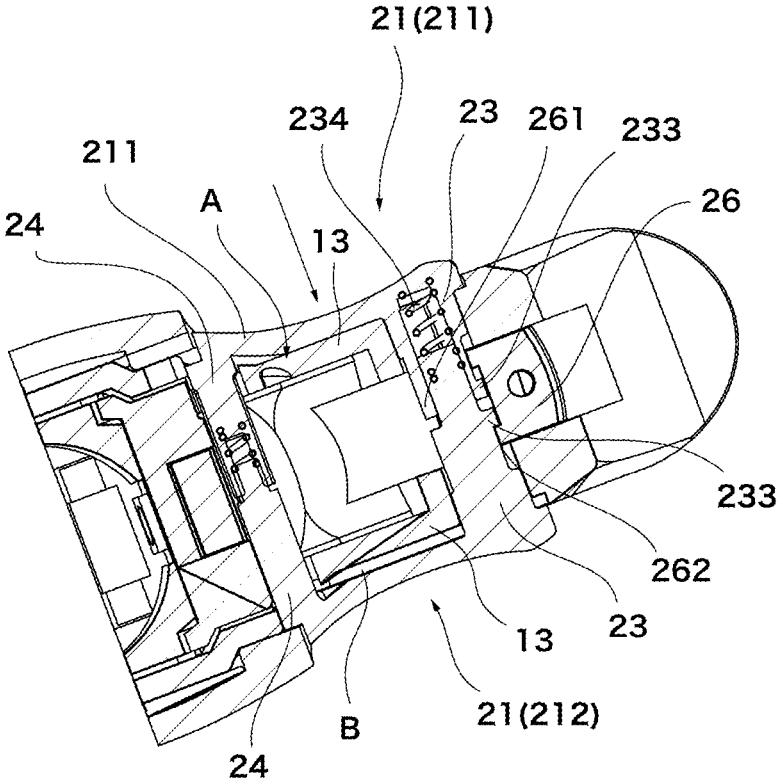
FIG. 30 is a partial enlarged sectional view of a safety on and a safety lever right moved inward of a toy gun in an implementation of an embodiment of the present invention with a safety on, taken along line AA of FIG. 29.
Figure 31:
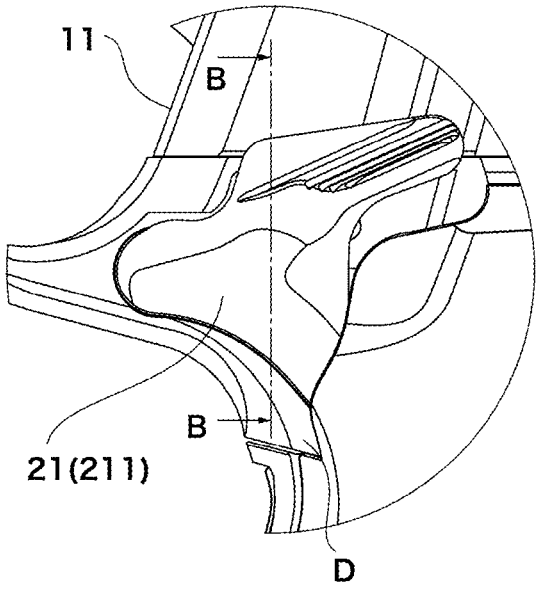
FIG. 31 is a partial enlarged view of a right side face of a safety lever right moved inward of a toy gun in an implementation of an embodiment of the present invention with a safety.

For example, as shown in FIG. 29 and FIG. 30, when the toy gun 11 is dropped with the right side thereof oriented downward as indicated by the arrow in FIG. 30 with the safety on, the weight of the toy gun 11 and the dropping impact are exerted on the safety lever right 211.

Even if the gun is dropped and the safety lever right 211 collides with the ground with the safety working, that is, the safety lever 21 on, as shown in FIG. 30, the safety lever right 211 is moved inward of the toy gun 11.

As a result, the space A between the frame 13 and the safety lever right 211 is eliminated but the space B between the frame 13 and the safety lever left 212 remains.

Owing to the movement of the safety lever right 211 and the safety lever left 212, even when great impact is applied to the safety lever 21 due to dropping of the toy gun 11, force applied to the safety lever 21 is attenuated by the safety lever spindle spring 234 and the safety guide spring 243.

This implementation of the present invention adopts the safety lever spindle spring 234 and the safety guide spring 243 having great repulsive force to some extent. This prevents the safety lever 21 from being moved inward of the gun while a user is manually operating the safety lever 21.

Figure 28:
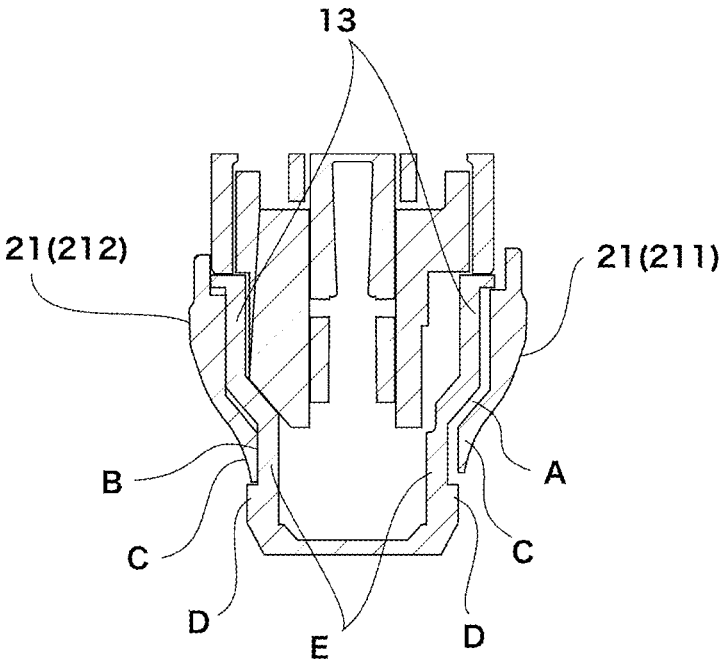
FIG. 28 is a partial enlarged sectional view of a safety lever left moved inward of a toy gun in an implementation of an embodiment of the present invention with a safety on, taken along line AA of FIG. 27.

As shown in FIG. 28 and FIG. 30, the safety lever 21 covers the frame 13 when the safety on, and a surface area E as a part of the frame 13 is on is slightly recessed so that the safety lever right 211 and the safety lever left 212 can be moved inward of the gun when the safety is on.

Switching of the manual safety between on and off is accomplished by rotating the safety lever 21 around the safety lever spindle 23.

When the manual safety is on, the free end of the safety lever 21 located at the front side of the toy gun 11 is moved to the upper side by rotating it. The contact portion C located at the inner lower end of the safety lever 21 is brought out of contact with the projection D, which is projected from the faces the frame 13 facing the space A and the space B.

Since the recess in the frame 13 and the safety lever 21 are fitted with each other when the safety is on, as shown in FIG. 26, FIG. 28, FIG. 30, and FIG. 32, the safety lever 21 can be moved inward of the toy gun 11.

Figure 32:
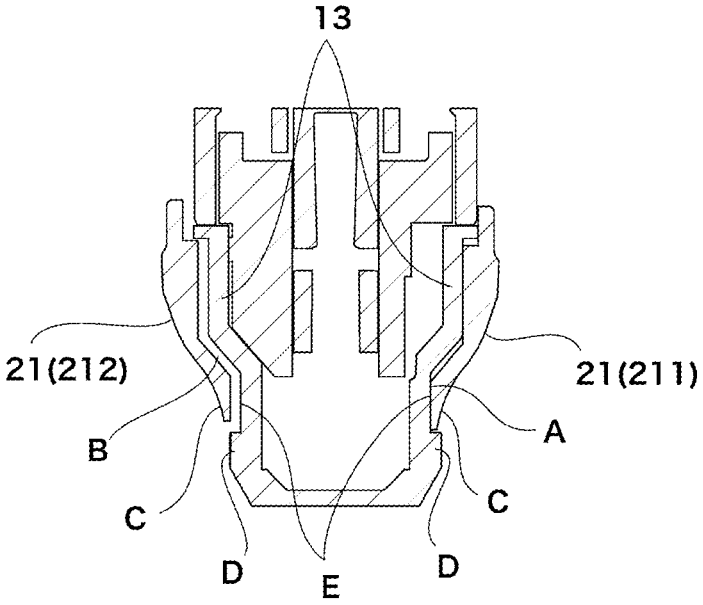
FIG. 32 is a partial enlarged sectional view of a safety lever right moved inward of a toy gun in an implementation of an embodiment of the present invention with a safety on, taken along line BB of FIG. 31.
Figure 33:
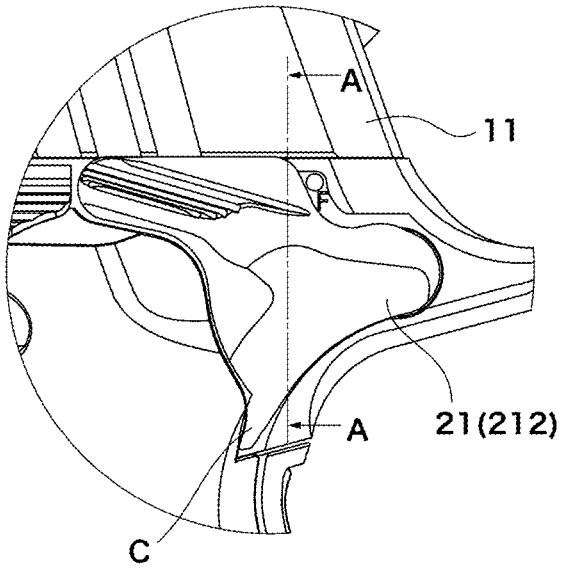
FIG. 33 is a partial enlarged view of a left side face of a toy gun in an implementation of an embodiment of the present invention with a safety off.

Even if an attempt is made to turn off the safety lever 21 with the safety lever 21 moved inward of the toy gun 11, as shown in FIG. 28 and FIG. 32, the lower part C of the safety lever 21 and the projection D of the frame 13 interfere and the safety cannot be turned off. Therefore, an accidental firing is not caused by dropping impact.

To turn off the manual safety, the safety lever 21 is rotated to move the free end thereof located at the front side of the toy gun 11 to the lower side. The contact portion C located inside the safety lever 21 is brought into contact with the projection D projected from the faces of the frame 13 facing the space A and the space B.

Figure 34:
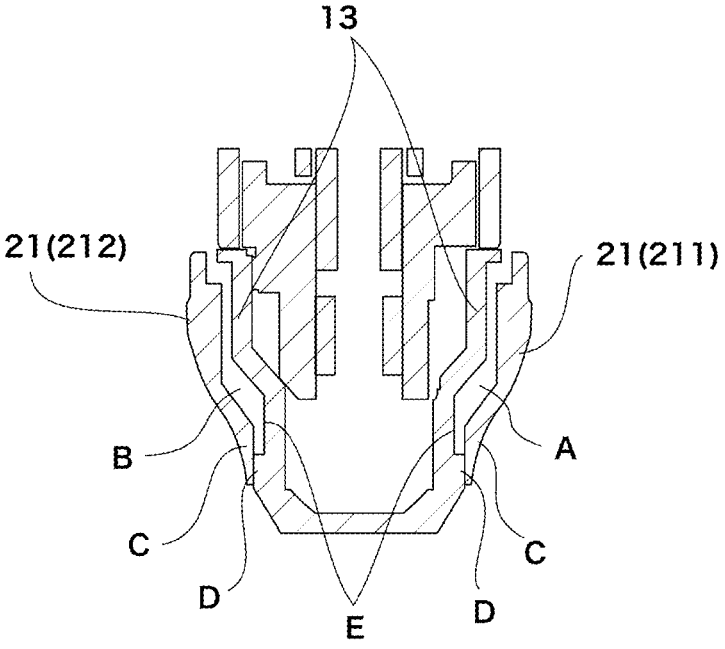
FIG. 34 is a partial enlarged sectional view of a toy gun in an implementation of an embodiment of the present invention with a safety off, taken along line AA of FIG. 33.
Figure 35:
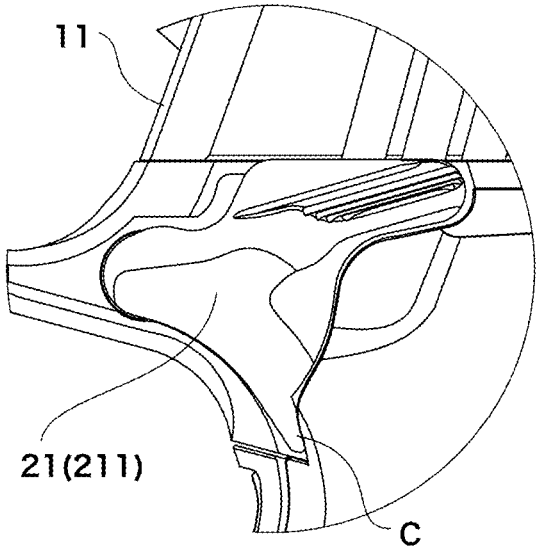
FIG. 35 is a partial enlarged view of a right side face of a toy gun in an implementation of an embodiment of the present invention with a safety off.
Figure 36:
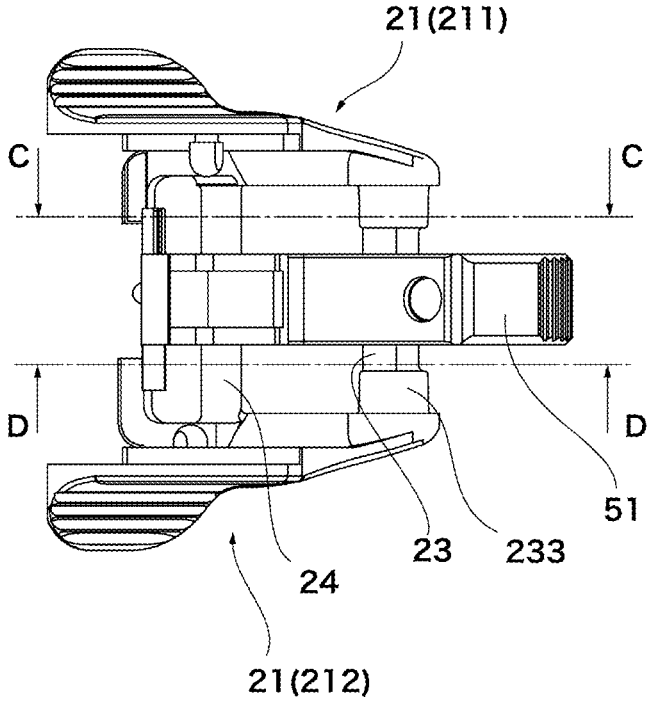
FIG. 36 is a plan view of a safety lever left, a safety lever right, a sear, and a hammer of a toy gun in an implementation of an embodiment of the present invention with a safety off.

When the manual safety is off, as shown in FIG. 34, the contact portion C located inside the safety lever 21 interferes with the projection D projected from the faces of the frame 13 facing the space A and the space B. For this reason, in this state, the safety lever 21 is not moved inward of the toy gun 11.

A description will be given to operations in which a bullet is fired in this embodiment of the present embodiment.

(1) A description will be given to a safety on state, shown in FIG. 23 and FIG. 24, in which a bullet cannot be fired even by pulling the trigger 31.

An attempt is made to pull the trigger 31. Then, the trigger bar 34 becomes about to move frontward in FIG. 6 and FIG. 7.

Then, the sear pressing portion 37 of the trigger bar 34 is abutted against the sear 41 and becomes about to press and rotate the sear 41.

However, as shown in FIG. 23 and FIG. 24, the sear locking portion 25 of the safety lever 21 is engaged with the trigger bar engaging portion-safety lever right engaging portion 43 and safety lever left engaging portion 44 of the sear 41. For this reason, the sear 41 is in abutment against the safety lever 21 and the sear 41 is immobilized. The sear 41 cannot be rotated.

That is, even by pulling the trigger 31, the sear pressing portion 37 of the trigger bar 34 cannot press the trigger bar engaging portion-safety lever right engaging portion 43 of the sear 41 and this prevents the trigger 31 from being fully pulled.

The hammer 51 immobilized by the sear 41 remains stopped and cannot be rotated. For this reason, a bullet is not fired.

In this embodiment, the sear locking portion 25 locks the sear 41 and stops the movement of the hammer 51. The safety lever 21 only has to be capable of being selectively in contact with or out of contact with any member of the trigger 31 to the hammer 51 by way of the sear 41 interlocked with one another.

(2) A description will be given to a safety off state, shown in FIG. 37 and FIG. 38, in which a bullet can be fired by pulling the trigger 31.

In FIG. 5, which is a left side sectional view of the toy gun 11 in this implementation with the safety off, reference numeral 61 denotes a hit pin and 62 denotes a valve. Reference numeral 71 denotes a gas cylinder; 64 denotes a gas passage; 65 denotes an inner barrel; 66 denotes a cylinder block; and 67 denotes a slide. In FIG. 5, the hammer locking portion 45 of the sear 41 and the sear engaging portion 53 of the hammer 51 are engaged with each other, as shown in FIG. 37 and FIG. 38; therefore, the hammer 51 is at rest.

The trigger 31 in the state shown in FIG. 5 is pulled. Then, the trigger bar 34 shown in FIG. 6 and FIG. 7 is moved frontward.

The sear pressing portion 37 of the trigger bar 34 is abutted against the sear 41 and presses and rotates the sear 41.

Figure 37:
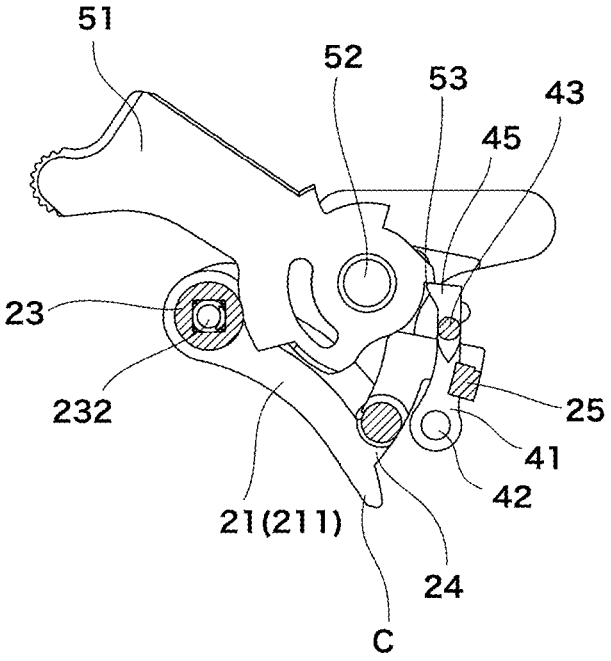
FIG. 37 is a right side sectional view of a safety lever left, a safety lever right, a sear, and a hammer of a toy gun in an implementation of an embodiment of the present invention with a safety off, taken along line CC of FIG. 36.
Figure 38:
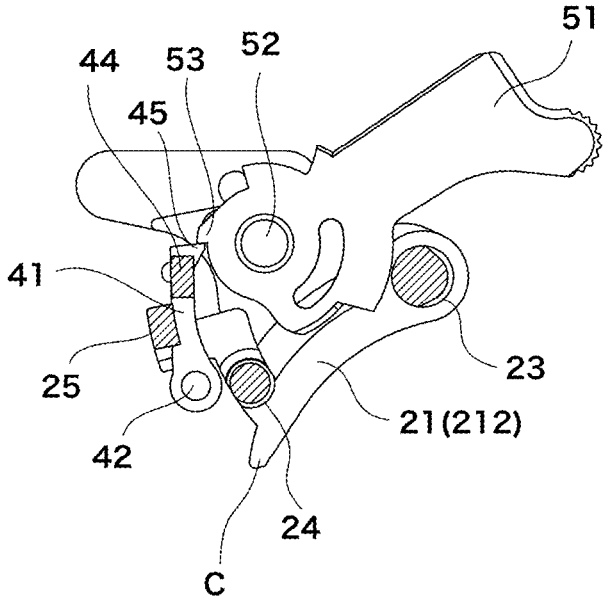
FIG. 38 is a left side sectional view of a safety lever left, a safety lever right, a sear, and a hammer of a toy gun in an implementation of an embodiment of the present invention with a safety off, taken along line DD of FIG. 36.
Figure 39:
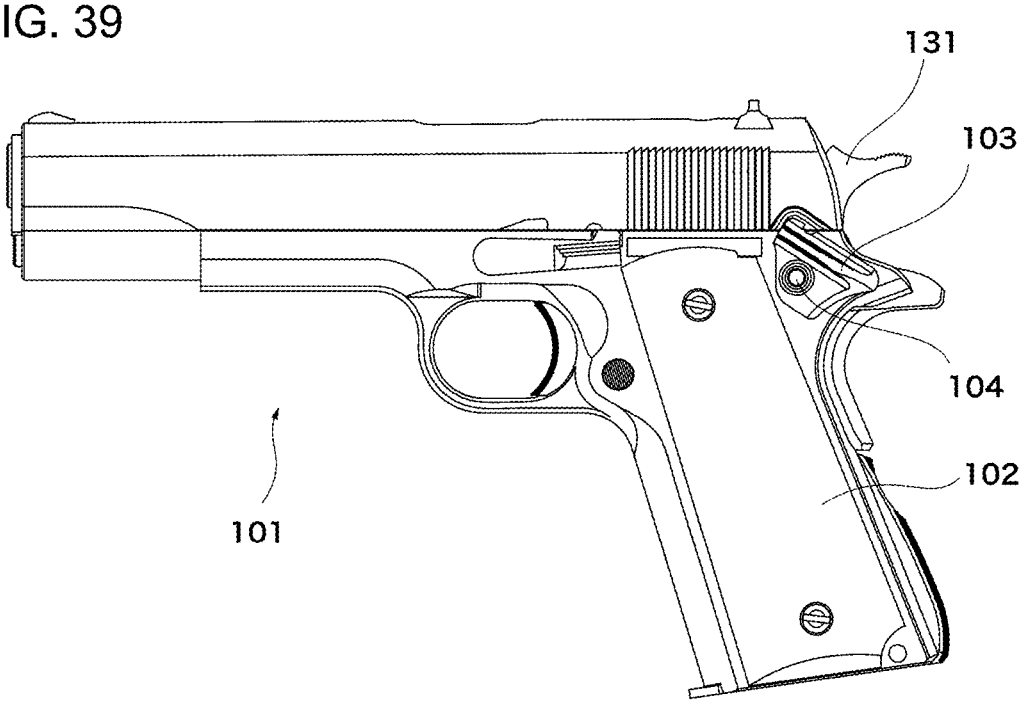
Figure 40:
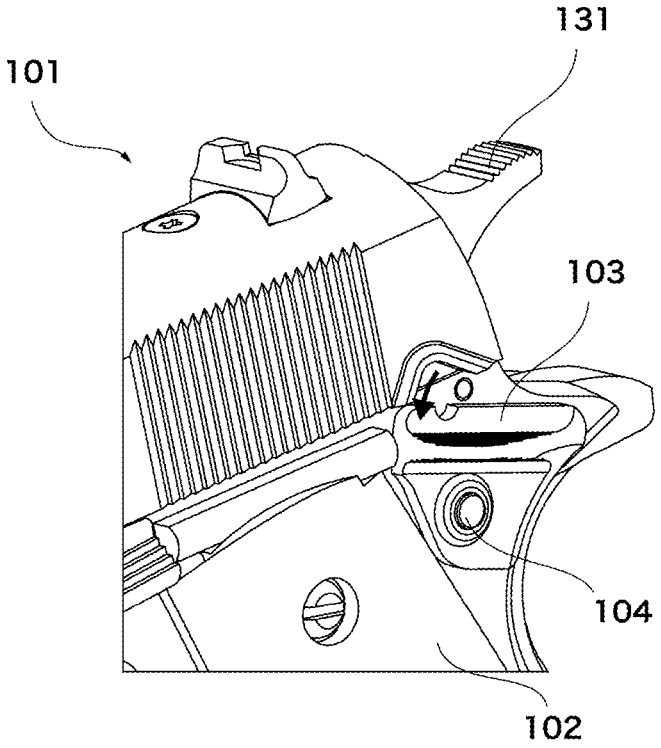
FIG. 40 is a partial enlarged perspective view of a toy gun in a conventional example with a safety off.
Figure 41:
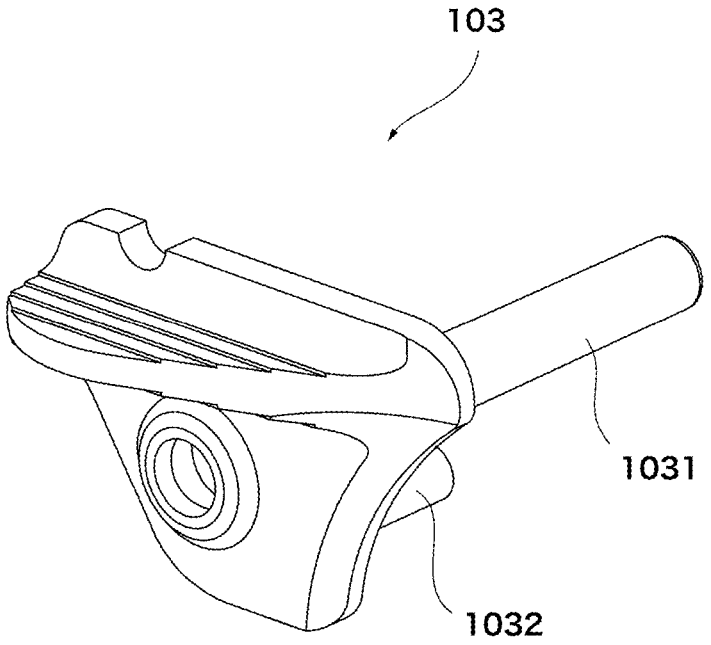
FIG. 41 is a front side perspective view of a safety lever of a toy gun in a conventional example.
Figure 42:
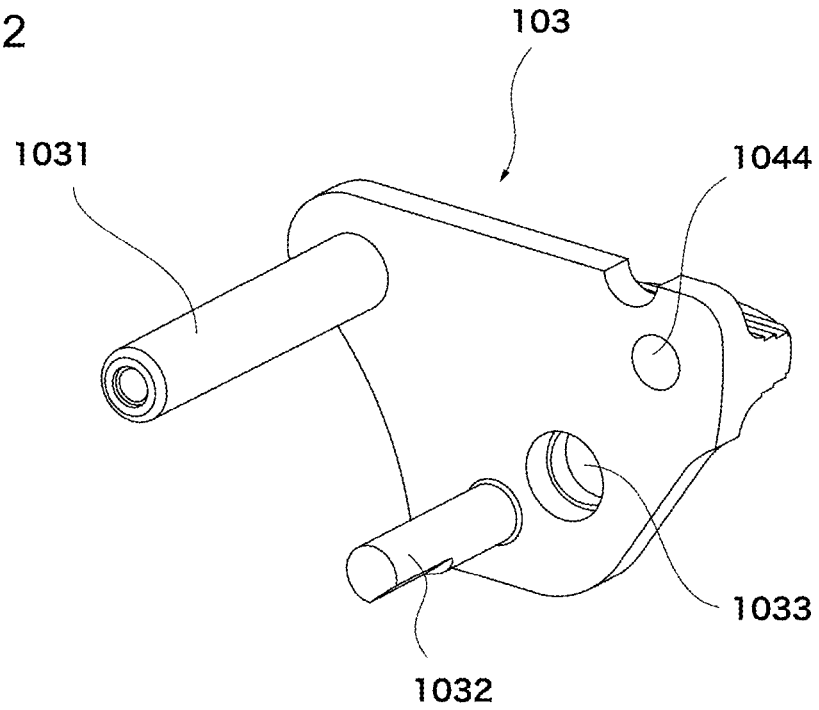
FIG. 42 is a back side perspective view of a safety lever of a toy gun in a conventional example.
Figure 43:
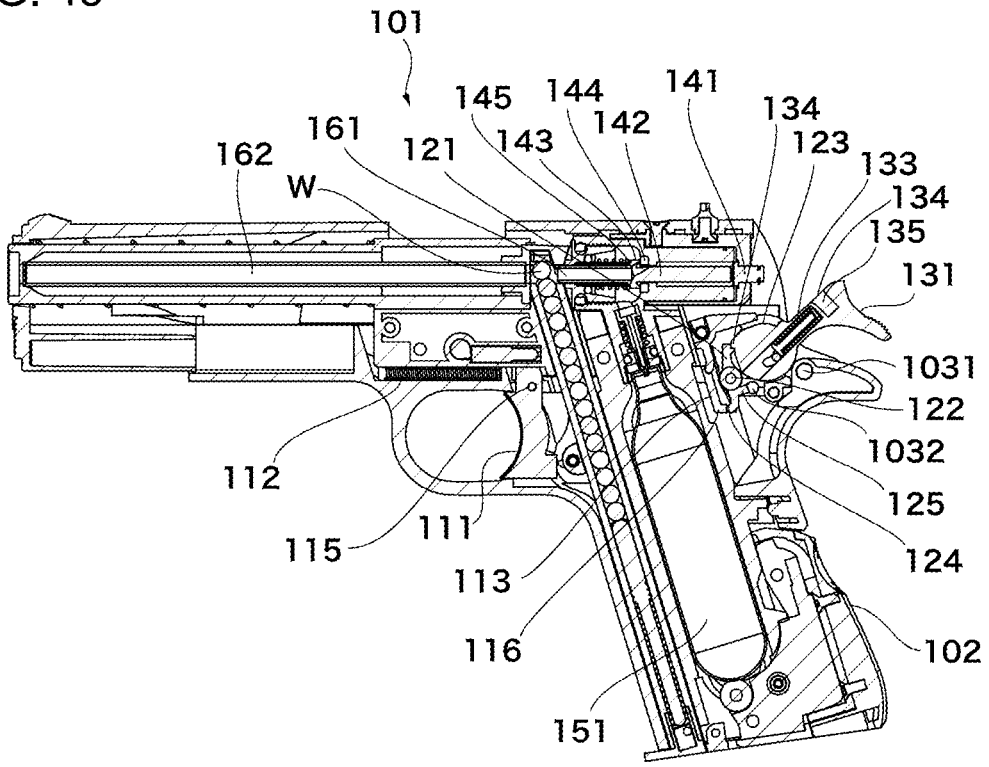
Figure 44:
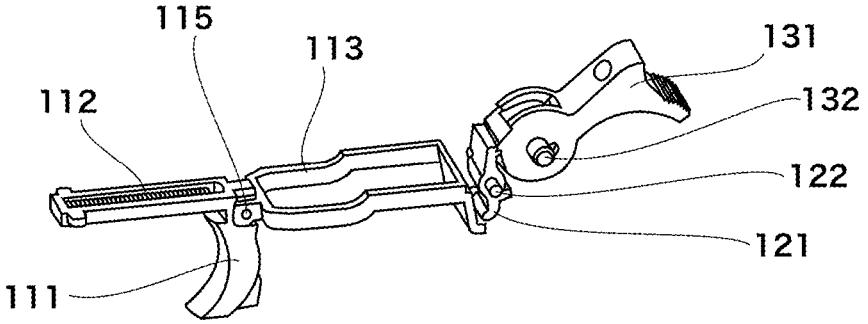
FIG. 44 is a left side perspective view of a trigger, a trigger spring, a trigger bar, a trigger bar spring, a sear, and a hammer of a toy gun in a conventional example.
Figure 45:
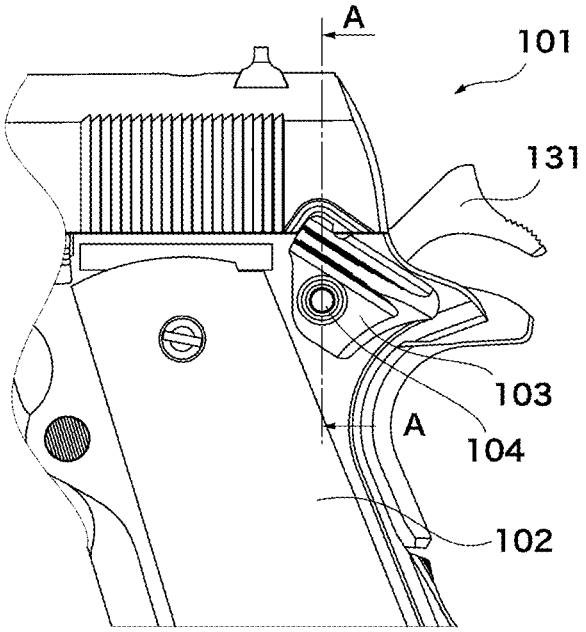
Figure 46:
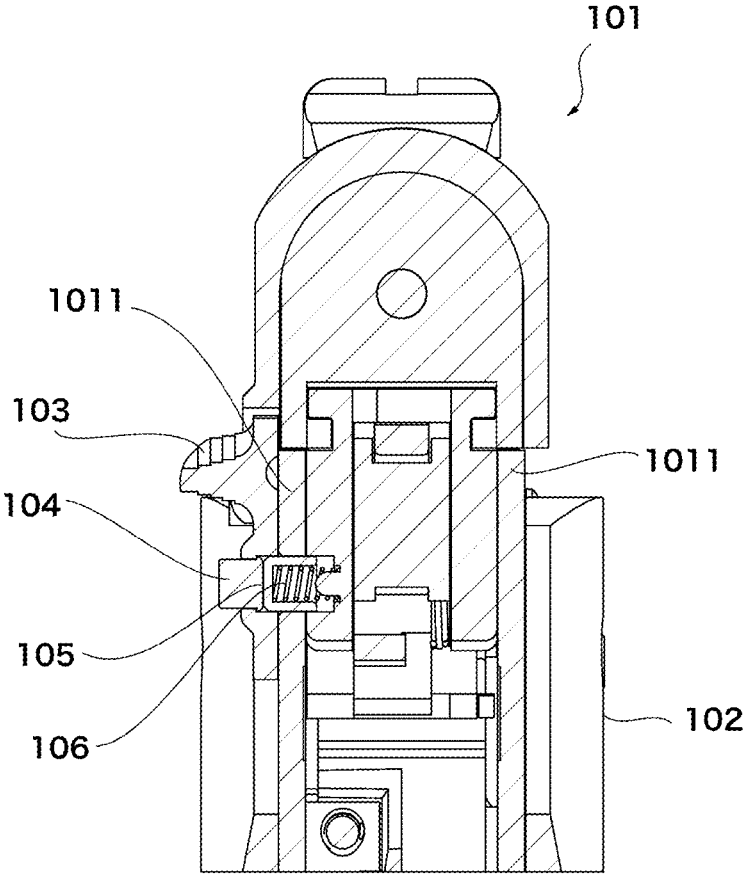
FIG. 46 is a sectional view of a toy gun in a conventional example, taken along line AA of FIG. 45.
Figure 47:
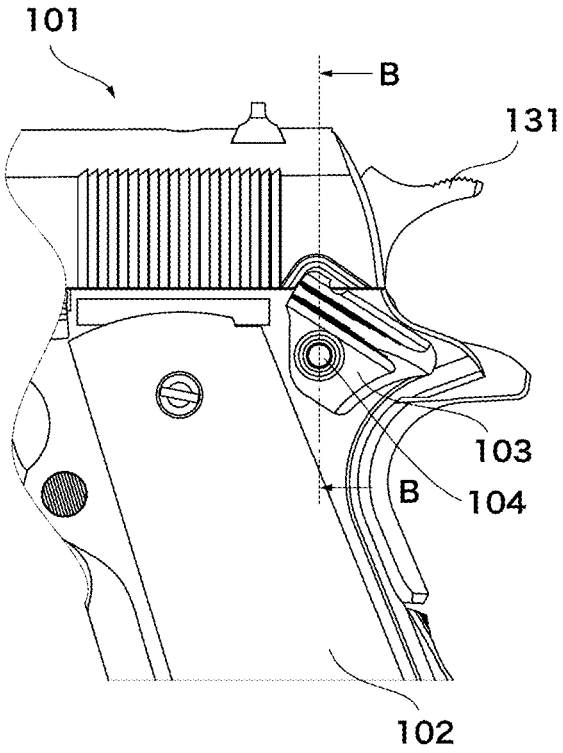
FIG. 47 is a partial enlarged view of a left side face of a toy gun in a conventional example with a safety on and a safety unlock button pressed.
Figure 48:
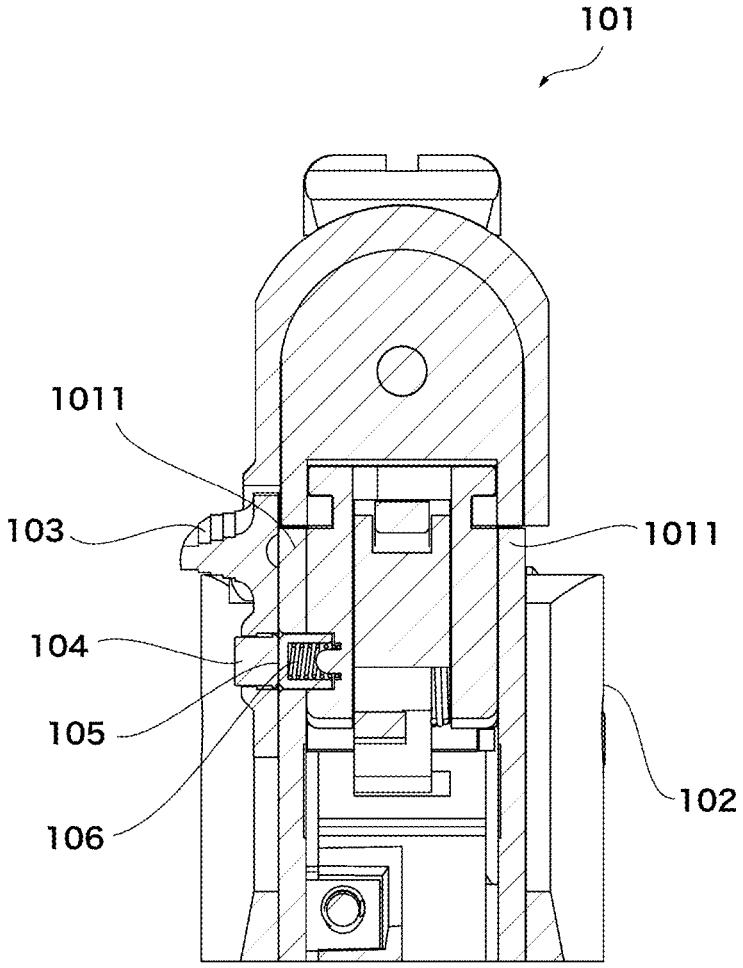
FIG. 48 is a sectional view of a toy gun in a conventional example, taken along line BB of FIG. 47.
Figure 49:
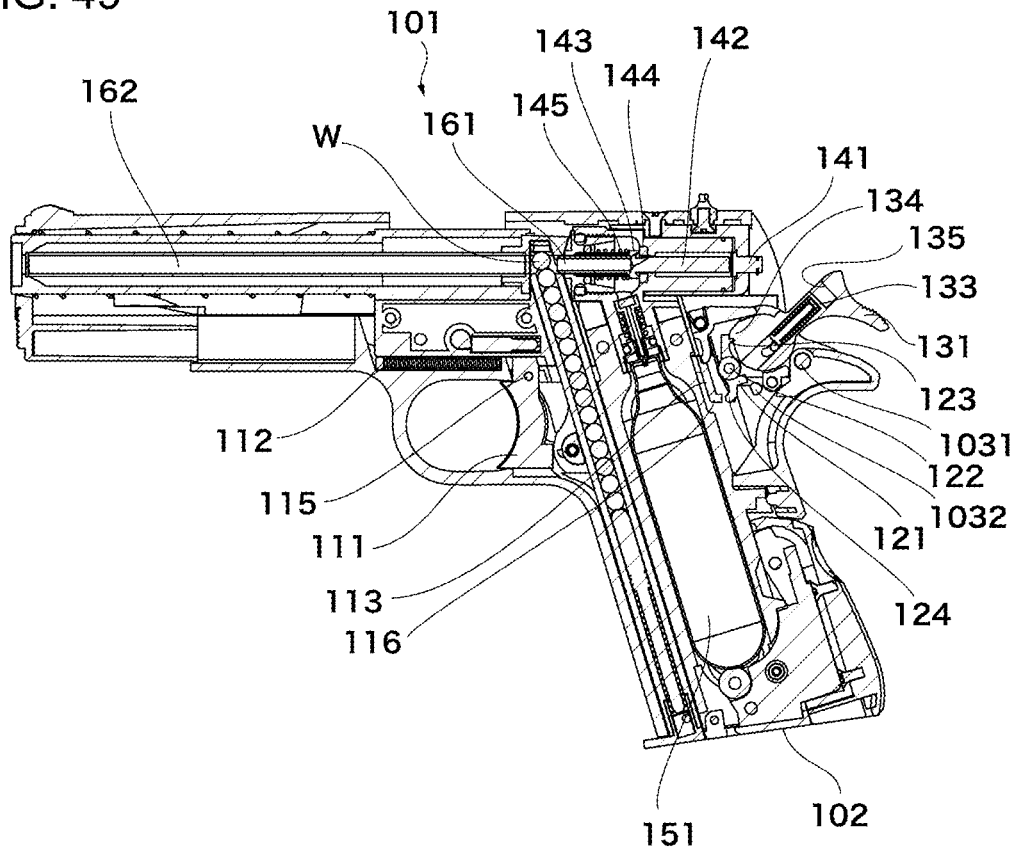
FIG. 49 is a sectional view of left side face of a toy gun in a conventional example with a safety off.
Figure 50:
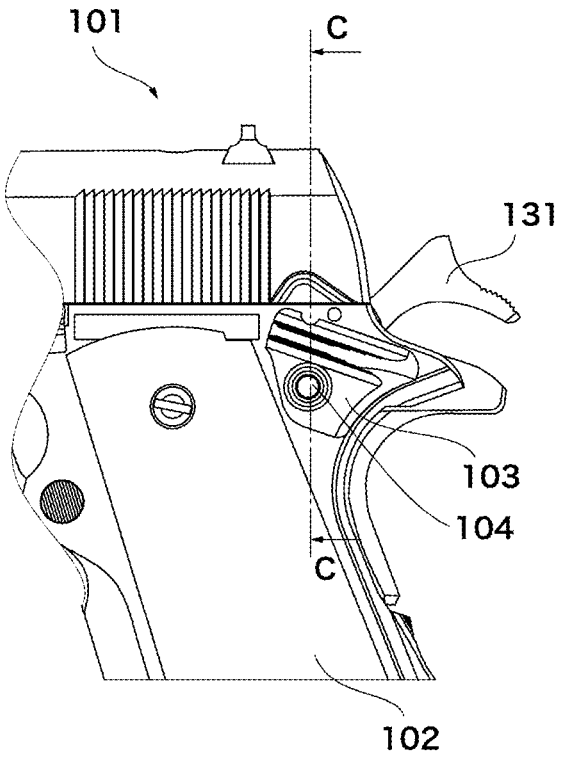
FIG. 50 is a partial enlarged view of a left side face of a toy gun in a conventional example with a safety off and a safety unlock button pressed.
Figure 51:
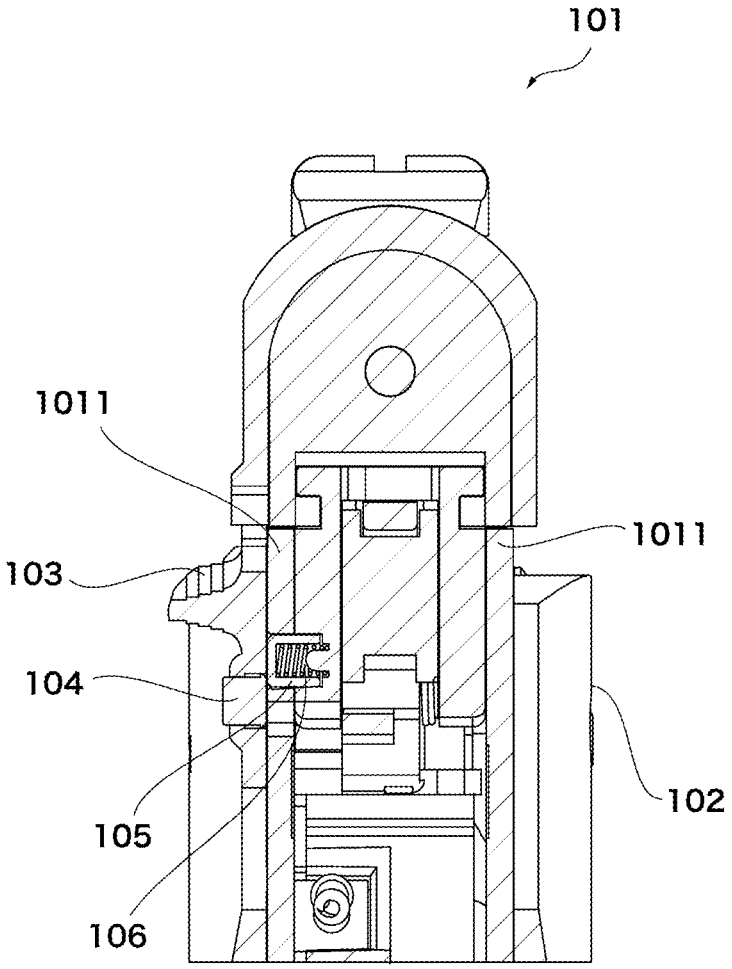
FIG. 51 is a sectional view of a toy gun in a conventional example, taken along line CC of FIG. 50.

In FIG. 37 and FIG. 38, the sear locking portion 25 of the safety lever 21 and the trigger bar engaging portion-safety lever right engaging portion 43 or the safety lever left engaging portion 44 of the sear 41 are not engaged with each other; therefore, the safety lever 21 is not engaged with the sear 41.

For this reason, when the trigger 31 is pulled as shown in FIG. 6 and FIG. 7, the trigger 31 is rotated counterclockwise around the trigger spindle 32 in FIG. 5. When the trigger 31 is rotated, the trigger bar 34 is moved frontward of the toy gun. As the result of the movement of the trigger bar 34 frontward of the toy gun, the sear pressing portion 37 of the trigger bar 34 can press the trigger bar engaging portion-safety lever right engaging portion 43 of the sear 41 frontward of the toy gun. For this reason, the sear 41 is rotated counterclockwise around the sear spindle 42 in FIG. 5.

When the sear 41 is rotated counterclockwise around the sear spindle 42 in FIG. 5, the hammer locking portion 45 of the sear 41 and the sear engaging portion 53 of the hammer 51 are disengaged from each other.

Then, the hammer 51 can be rotated around the hammer spindle 52.

The hammer 51 is rotated and the hit pin pressing portion 54 of the hammer 51 hits on the hit pin 61 and this moves the hit pin 61 frontward of the toy gun 11.

The hit pin 61 moves the valve 62 frontward of the gun. Then, the valve 62 is moved frontward of the toy gun 11.

The packing contact portion 69 of the valve 62 and the packing 68 are brought out of contact with each other, thereby unsealing the air tight in the valve 62. At this time, gas in the gas cylinder 71 has already flowed into a valve body 63.

Subsequently, gas in the valve body 63 flows into the gas passage 64 in the valve 62. Then, the gas flows out of the gas passage 64 in the valve 62 toward the inner barrel 65.

A bullet located at the rear end of the inner barrel 65 is moved frontward by gas pressure and the bullet is fired. At the same time as the firing of the bullet, the gas flows also into the cylinder block 66.

The slide 67 with the cylinder block 66 incorporated therein is moved rearward of the gun by gas pressure in the cylinder block 66 and a blowback is caused.

The cylinder block 66 is abutted against the trigger bar 34 and rotates the trigger bar 34.

The trigger bar 34 and the sear 41 are disengaged from each other and the sear 41 is returned to its original position. The trigger 31 and the hammer 51 are respectively returned to their original positions.

Then, the sear 41 is engaged with the hammer 51 again.

Conventional toy guns require operations different from those for real guns. That is, it is required to press a safety unlock button and then rotate a safety lever.

In this implementation of the present invention, the safety lever 21 is not locked when the manual safety is turned on. Therefore, a safety unlock button is unnecessary and thus neither a safety lock nor a safety unlock button is provided.

In an operating method for the safety lever 21 to switch the manual safety from on to off, the safety lever 21 only has to be pressed down as shown by the arrows in FIG. 3 and FIG. 4. This operating method is the same as that for a manual safety of a real gun on which the toy gun of the present invention is based and the appearance of the toy gun of the present invention is also the same as that of a real gun on which the toy gun is based.

Hereinbefore, the present invention has been described with reference to the embodiments, but the present invention is not limited thereto. It is obvious to those skilled in the art that various modifications, replacements, combinations and the like may be made, for example. It should be understood that the invention is not limited to the above-described embodiment, but may be modified into various forms on the basis of the spirit of the invention. Additionally, the modifications are included in the scope of the invention.

What is claimed is:

1. A toy gun comprising:

a frame provided in the toy gun;

a trigger attached to the toy gun;

a sear interlocked with an action of the trigger;

a hammer jetting gas out of a cylinder to fire a bullet by interlock with an action of the sear;

a safety lever composed of right and left safety levers which are installed outside the frame with a gap between each of the safety levers and the frame and being selectively in contact with or out of contact with any member of the trigger to the hammer interlocked with one another; and a biasing means providing bias as to maintain the gap between each of the right and left safety levers and the frame respectively in opposite directions.

2. The toy gun according to claim 1, wherein any member of the trigger to the hammer interlocked with one another is the sear.

3. The toy gun according to claim 1, wherein the safety lever is provided on right and left sides of the frame.

4. The toy gun according to claim 2, wherein the safety lever is provided on right and left sides of the frame.

5. The toy gun according to claim 1, wherein the frame has a recess fitted with the safety lever.

* * * * *